US006293418B1

(12) United States Patent
Ogden et al.

(10) Patent No.: US 6,293,418 B1
(45) **Date of Patent: *Sep. 25, 2001**

(54) COLLAPSIBLE CONTAINER

(75) Inventors: Don M. U. Ogden, Palgrave; Narayan Raghunathan, Mississauga, both of (CA); David Anthony Lazarski, Lancaster; James Howard Klein, Varysburg, both of NY (US)

(73) Assignee: Norseman Plastics Limited (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/457,527

(22) Filed: Dec. 9, 1999

(51) Int. Cl.[7] ..... B65D 7/00
(52) U.S. Cl. ..... 220/7; 220/6
(58) Field of Search ..... 220/6, 7, 324, 220/326

(56) References Cited

U.S. PATENT DOCUMENTS

| | | | | |
|---|---|---|---|---|
| 2,799,423 | * | 7/1957 | Kaye | 220/7 |
| 4,923,079 | * | 5/1990 | Foy | 220/7 |
| 5,398,834 | | 3/1995 | Umiker | 220/6 |
| 5,515,987 | * | 5/1996 | Jacques et al. | 220/6 |
| 5,699,926 | * | 12/1997 | Jacques et al. | 220/6 |
| 5,746,342 | | 5/1998 | Jacques et al. | 220/6 |
| 5,853,099 | | 12/1998 | Lessard | 220/7 |
| 5,967,356 | | 10/1999 | Laarhoven et al. | 220/6 |
| 6,015,056 | | 1/2000 | Overholt et al. | 220/6 |
| 6,029,840 | | 2/2000 | Brauner | 220/6 |
| 6,098,827 | | 8/2000 | Overholt et al. | 220/6 |

FOREIGN PATENT DOCUMENTS

| | | | |
|---|---|---|---|
| 2175316 | 10/1997 | (CA) | B65D/6/18 |
| 2201010 | 9/1998 | (CA) | B65D/6/24 |

* cited by examiner

*Primary Examiner*—Steven Pollard
(74) *Attorney, Agent, or Firm*—Katten Muchin Zavis

(57) ABSTRACT

A collapsible container for storage and transport of produce or other goods is provided. In one embodiment, there is provided a five piece collapsible container with abase and four pivotable walls. Each of the four walls are outwardly collapsible to facilitate washing, and inwardly collapsible for compact storage. A latch mechanism is provided at each of the four points where two sidewalls abut each other providing a rigid assembled container. Attached to each latch mechanism is an actuating member with a grip. There is a latch mechanism on each side of each of two opposing sidewalls and latch actuators with grips that in close proximity to each other. The two grips allow the operator to disengage both latches integral with one side of the container with one hand. Similarly, when collapsing the container from assembled position, all four latches can be disengaged with each hand at respective pairs of grips. The latches are readily disengageable while providing a rigid assembled container.

31 Claims, 22 Drawing Sheets

COLLAPSIBLE CONTAINER

FIELD OF THE INVENTION

This invention relates to injection molded containers, and more particularly, to a collapsible container.

BACKGROUND OF THE INVENTION

Many transport and storage containers are known. Certain collapsible containers are used to transport goods such as produce and other perishables. Collapsible containers are commonly rectangular in shape with four sidewalls hinged to the base. More recent collapsible containers are injection molded plastic having sidewalls that collapse outwardly for cleaning and inwardly for storage. The sidewalls are latched in an assembled position and unlatched in a collapsed position.

A collapsable container is taught in WO Patent Application 99/32362. This container includes a base, two sidewalls, and two end walls. A pair of opposing sidewall edges and a pair of opposing end wall flanges are integral with the base and depend therefrom. The end walls are pivotablv attached to each wall flange and include defined comers at each side that abut the corresponding sidewalls. A pair of opposing sidewalls are pivotably attached to the sidewall edges. Each sidewall has a latch member at each lateral edge and each end wall has a pair of flanges with a latch receiver for capturing the latch member in the assembled position Each latch member comprises a rigid, substantially parallelopiped body and a raised tooth at its distal end. The latch receiver includes an aperture to receive the latch member and a resiliently deformable latch hinge with a lip complementary to the raised tooth. The latch hinge has a resting position that locks the tooth and a flexed position to allow the latch member to pass through the aperture.

During assembly of the container from the collapsed position, each latch member is inserted in the corresponding aperture. As the latch member passes through the aperture, the raised tooth flexes the latch hinge upwards from the rest position, temporarily flexing the latch hinge into the flexed position. In the assembled position, the raised tooth is locked on the outside of the latch hinge as it returns to rest position. The lip of the latch hinge abuts the tooth to retain the latch member in the aperture. Users of the container will appreciate that the assembly can be somewhat awkward as each opposing end wall must be outwardly collapsed at a given angle greater than forty-five degrees to the end wall flange when the each sidewall is moved upright into the assembled position. Furthermore, both corresponding sidewalls must be held upright to latch one end wall into place.

Returning the container to the collapsed position from the assembled position, each latch hinge is moved to the flexed position, raising the lip of the latch hinge so it no longer abuts the tooth. Each latch hinge is flexed by depressing the latch hinge, typically with the thumb and forefinger of one hand, while forceably separating the corresponding sidewall with the other hand. The latch member and tooth can then be released from the latch receiver. Because of the configuration of the container, this procedure must be repeated for each latch receiver in order to release each latch member and finally collapse the container.

A second five piece collapsible container is manufactured by the Rehrig Pacific Company, 4011 East 26$^{th}$ Street, Los Angeles Calif. 90025. The latch member and latch receiver are geometrically different from the container in WO 99/32362 but are functionally similar. As a result, it still requires the same awkward procedure to collapse the container.

An example of a five piece container that is less awkward to collapse is produced by Wavin Plastics Limited. This container has sidewall edges that are joined in the comers, but unlike the collapsible container taught in WO 99/32362, can only be collapsed inwardly. There is also a latch member with a striker and a latch release member. The latch release member extends from the latch member to an activation point on the sidewall of the container. A second latch member is attached to the same sidewall. A second latch release member extends from the second latch member to a second activation point. The first and second activation points are in close proximity to each other so that both release members can be activated with one hand thereby releasing both associated latch members. Thus the container can be easily collapsed by actuating each of two sets of latch release members. Users of the container can appreciate that this latching mechanism and the assembled container is less rigid than the aforementioned collapsible containers. Further, because the container can only collapse inwardly, it is more difficult to clean.

SUMMARY OF THE INVENTION

It is an object of the present invention to provide a novel collapsible container that obviates or mitigates at least one of the disadvantages of the prior art.

In one aspect of the invention there is provided a collapsible container comprising a base, a pair of first opposing sidewalls pivotably attached to the base, and a pair of second opposing sidewalls pivotably attached to the base. The sidewalls have an assembled position, an outwardly collapsed position, and an inwardly collapsed position. A latch bar is attached to each end of each of the first opposing sidewalls and a latch member is attached to each end of the second opposing sidewalls. The latch member is biased to releasably capture a respective latch bar when the sidewalls are in the assembled position. A latch actuator is attached to each latch member and extends along a respective second sidewall to a grip. Each second sidewall has a pair of grips proximal to each other such that each pair of grips can be actuated with one hand to urge the latch member to release the latch bar.

A collapsible container for storage and transport of produce or other goods is provided. In one embodiment, there is provided a five piece collapsible container with a base and four pivotable walls. Each of the four walls are outwardly collapsible to facilitate washing, and inwardly collapsible for compact storage. A latch is provided at each of the four points where two sidewalls abut each other providing a rigid assembled container. Attached to each latch is an actuating member with a grip. The grips are paired to allow the operator to disengage both latches on one side of the container with one hand. Similarly, when collapsing the container from assembled position, all four latches can be disengaged with each hand at respective pairs of grips. The latches are readily disengageable and provide a rigid assembled container.

BRIEF DESCRIPTION OF THE DRAWINGS

The present invention will now be explained, by way of example only, with reference to certain embodiments and the attached Figures in which.

DETAILED DESCRIPTION OF THE INVENTION

Figure 1:
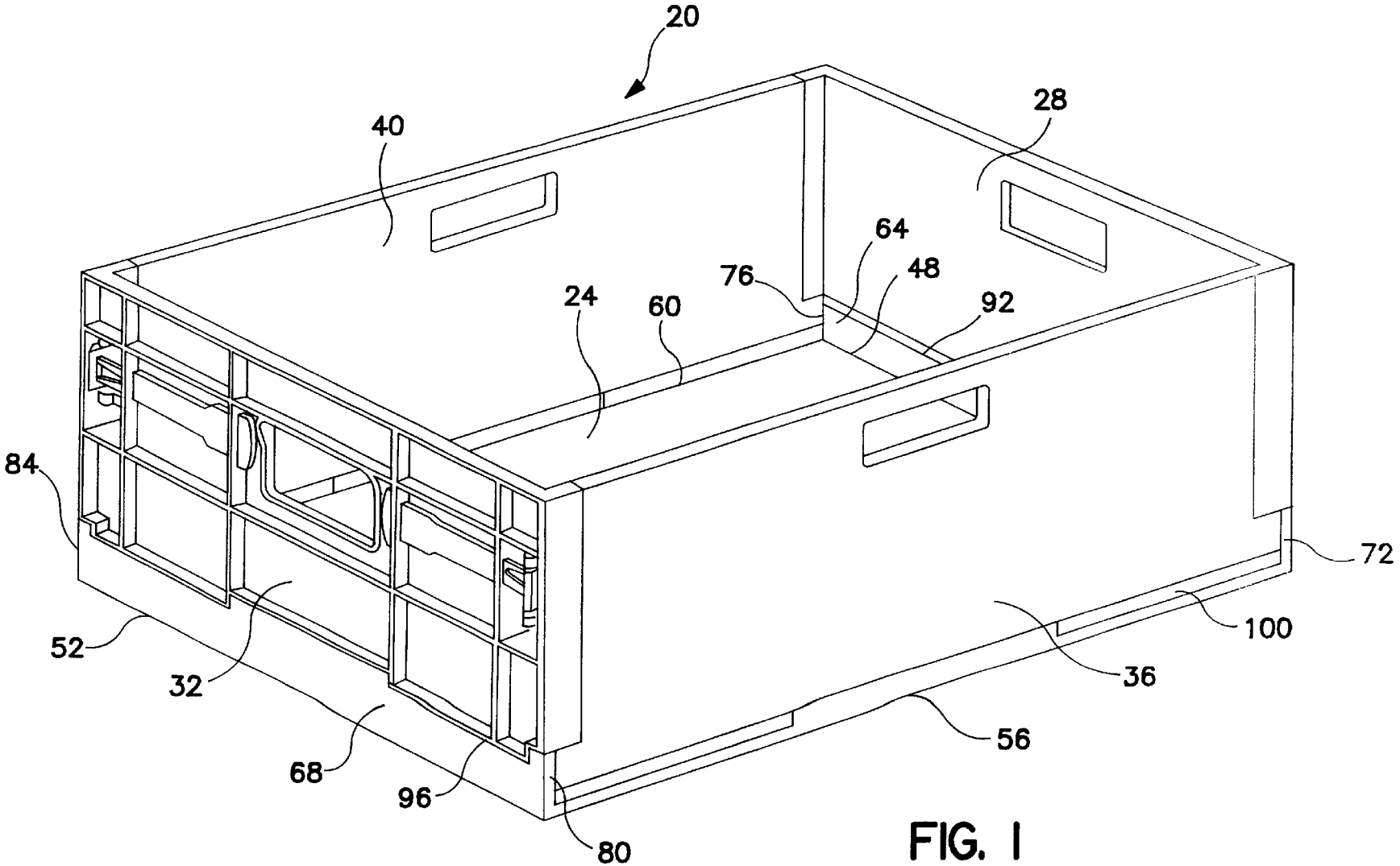
FIG. 1 is a perspective view of the collapsible container with the sidewalls in the assembled position.
Figure 2:
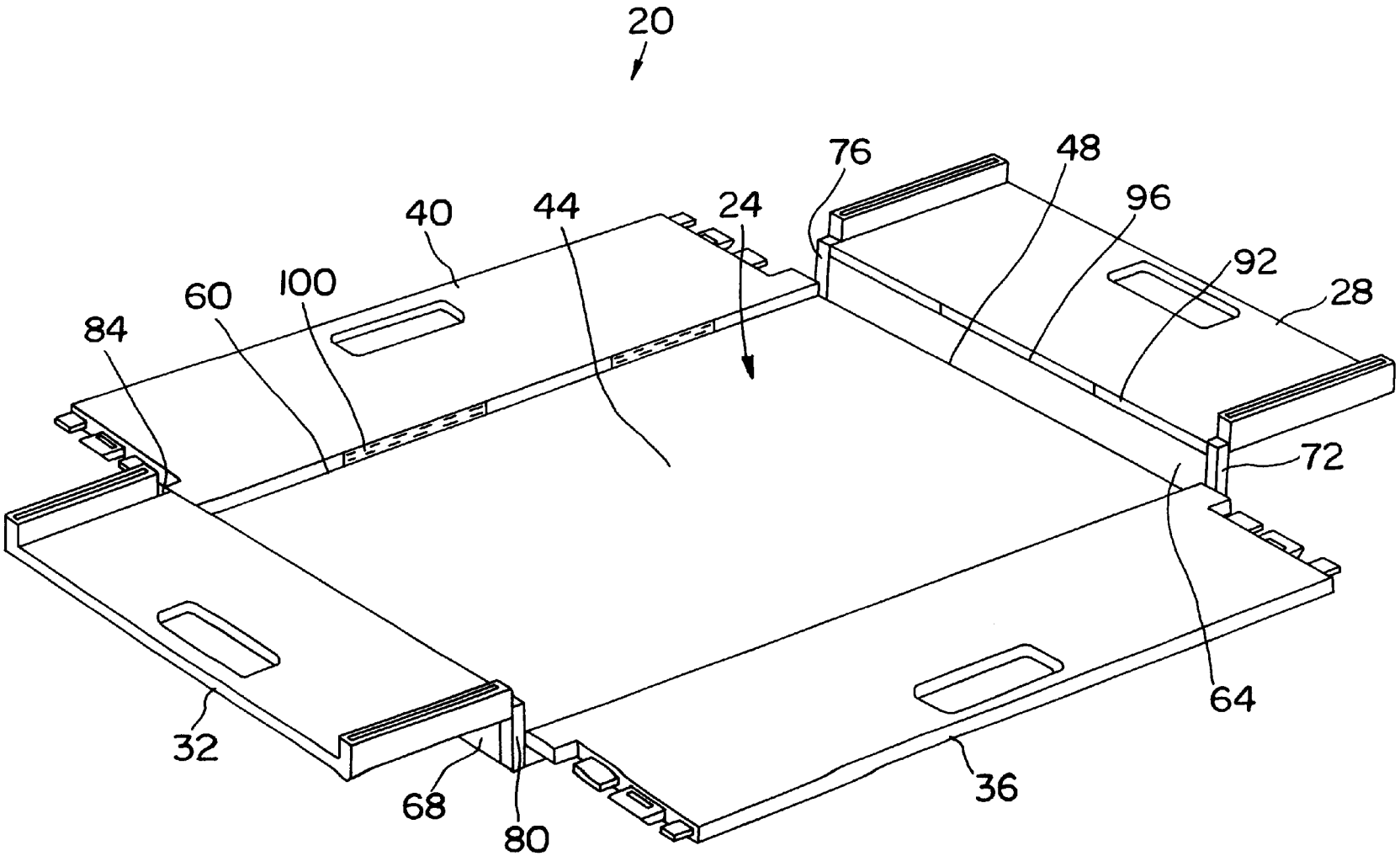
FIG. 2 is a perspective view of the collapsible container with the sidewalls in the outwardly collapsed position.
Figure 3:
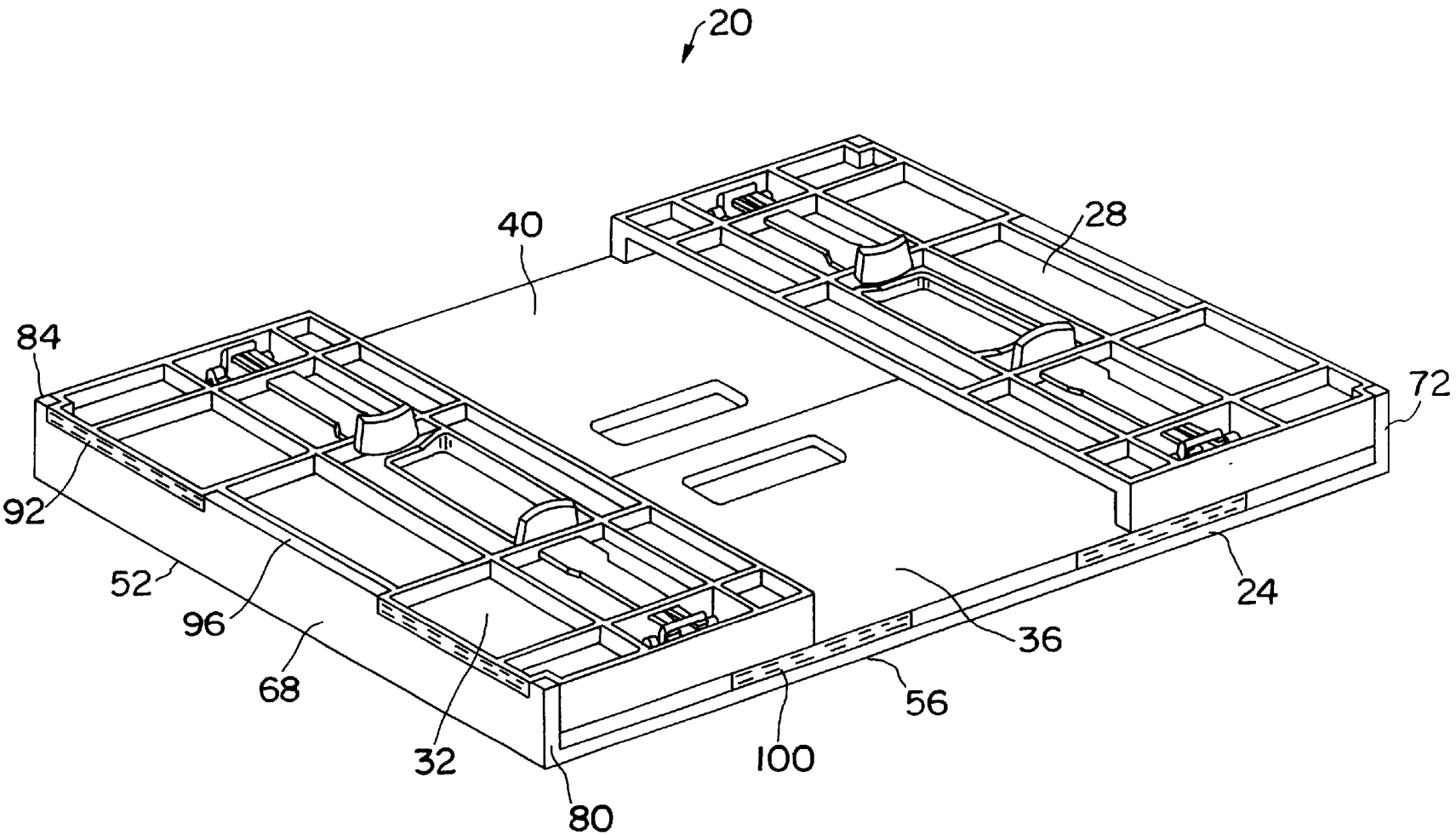
FIG. 3 is a perspective view of the collapsible container with the sidewalls in the inwardly collapsed position.

Referring to FIGS. 1–3, a collapsible container in accordance with an embodiment of the invention is indicated generally at 20. Container 20 is preferably used to transport and/or store products such as produce and other perishables. In a present embodiment, container 20 is injection-molded polymer such as polypropylene but other materials and forming processes can be used. Container 20 comprises a base 24 and four sidewalls 28, 32, 36, and 40 that are pivotally attached to base 24. The pivotal attachment will be discussed in greater detail below. Sidewalls 28, 32, 36, and 40 have three positions. In the assembled position, shown in FIG. 1, container 20 is used for transporting or storing product, whereby all four sidewalls 28, 32, 36, and 40 are substantially normal to base 24. In the outwardly collapsed position, shown in FIG. 2, sidewalls 28, 32, 36, and 40 are pivoted away from each other, and are substantially co-planar with base 24, thus exposing the interior of the container to facilitate washing. In the inwardly collapsed position shown in FIG. 3, sidewalls 8, 32, 36, and 40 are pivoted toward each other and are substantially parallel to base 24 thus facilitating the storage and transport of container 20 when it is empty.

In the present embodiment, base 24 is substantially planar with a rectangular footprint 44. Base 24 has two opposing short sides 48 and 52 and two opposing long sides 56 and 60. Each of short sides 48 and 52 include a base flange 64 and 68, respectively, projecting normally from footprint 44. Each side of base flanges 64 and 68 has comer sections 72, 76, 80 and 84. respectively, that are normal to footprint 44 and integral with base flanges 64 and 68 and long sides 56 and 60. Each of base ranges 64 and 68 have hinge posts 92 along the edge 96 for pivotal attachment to sidewalls 28 and 32, respectively. Long sides 56 and 60 have hinge posts 100 for pivotal attachment with sidewalls 36, 40 respectively.

Figure 4:
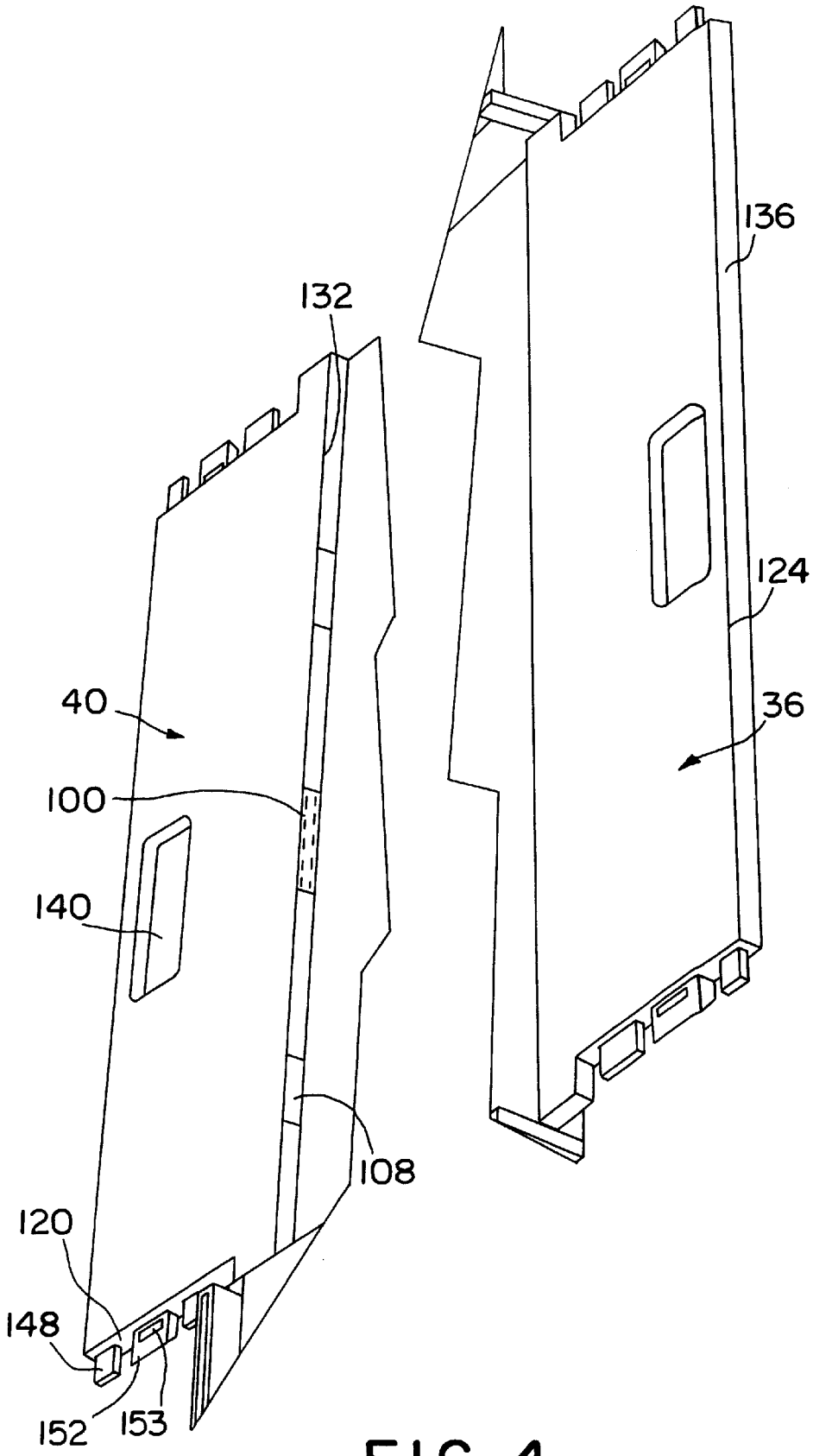
FIG. 4 is a perspective view of the two opposing long sidewalls of the collapsible container.

As best seen in FIG. 4, a plurality of u-channel shaped hangers 108 on long sidewalls 36 and 40 are complementary with hinge posts 100 and pivotally attachable thereto. Long sidewalls 36, 40 are substantially rectangular and are defined by short sides 120 and long sides 124. Hangers 108 are attached to a contacting edge 132 on long sidewalls 36, 40. Each long sidewall 36, 40 has a free edge 136 opposite contacting edge 132. Nearest to free edge 136 and centred on sidewall 36, 40 is a handle 140 for grasping container 20. Each long sidewall 36, 40 has tabs 148 and a rigid latch bar 152 protruding from each short side 120. Latch bar 152 is substantially rectangular with a catch aperture 153 substantially centred therein and an outwardly bevelled free end 154.

Figure 5:
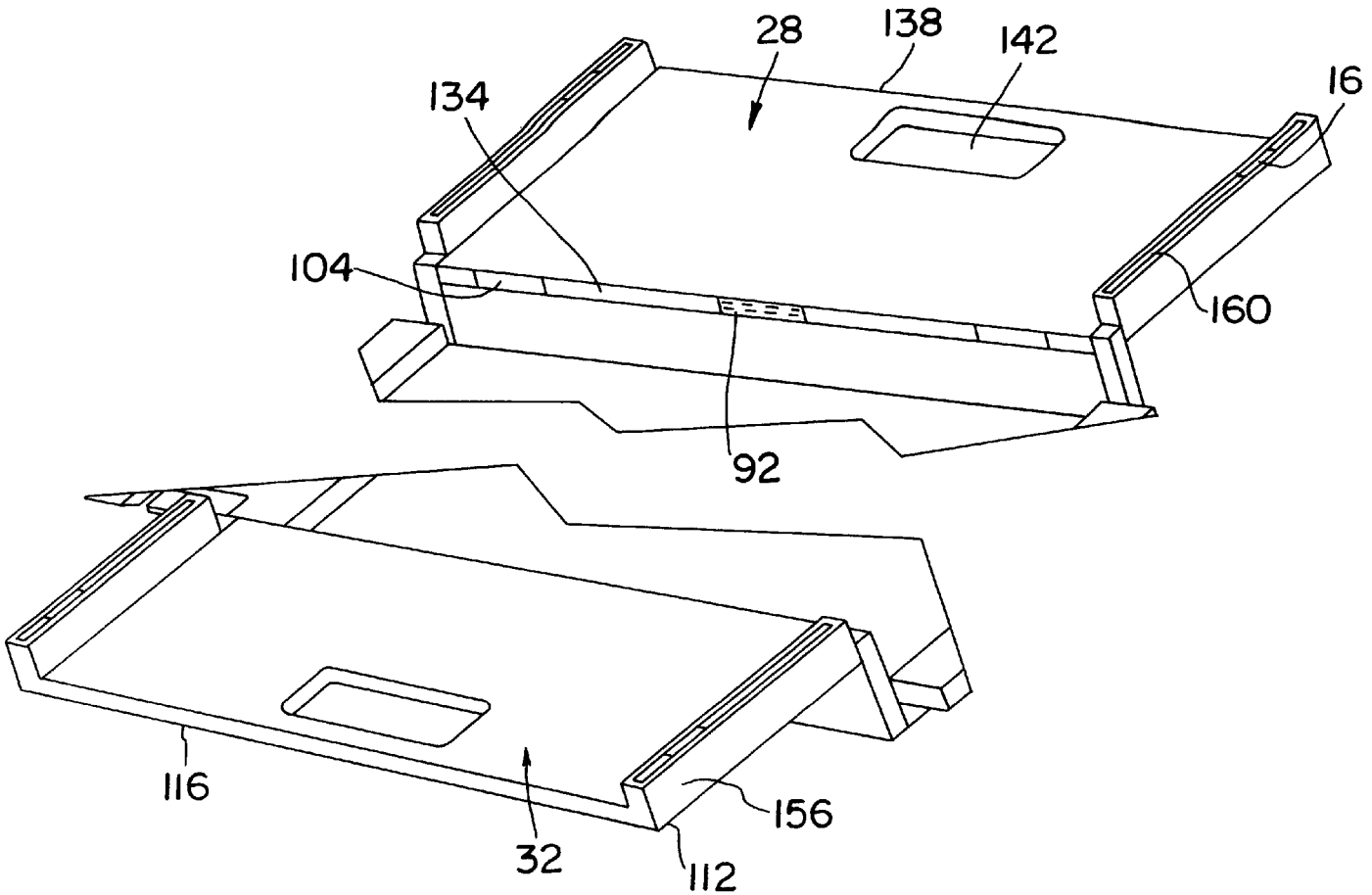
FIG. 5 is a perspective view of the two opposing short sidewalls of the collapsible container.

As best seen in FIG. 5, a plurality of u-channel shaped hangers 104 on short sidewalls 28 and 32 are complementary with hinge posts 92 and pivotally attached thereto. Short sidewalls 28 and 32 are substantially rectangular and are defined by short sides 112 and long sides 116. Hangers 104 are attached to a contacting edge 134 on short sidewalls 28, 32. Each short sidewall 28, 32 has a free edge 138 opposing contacting edge 134. Nearest to free edge 138 and centred on sidewall 28, 32 is a handle 142 for grasping container 20. At each short side 112 of short sidewalls 28, 32, is a wall flange 156 protruding substantially normal to sidewall 28, 32. Integral with each wall flange 156, is a tab receiving aperture 160 and a latch member 164.

Figure 6:
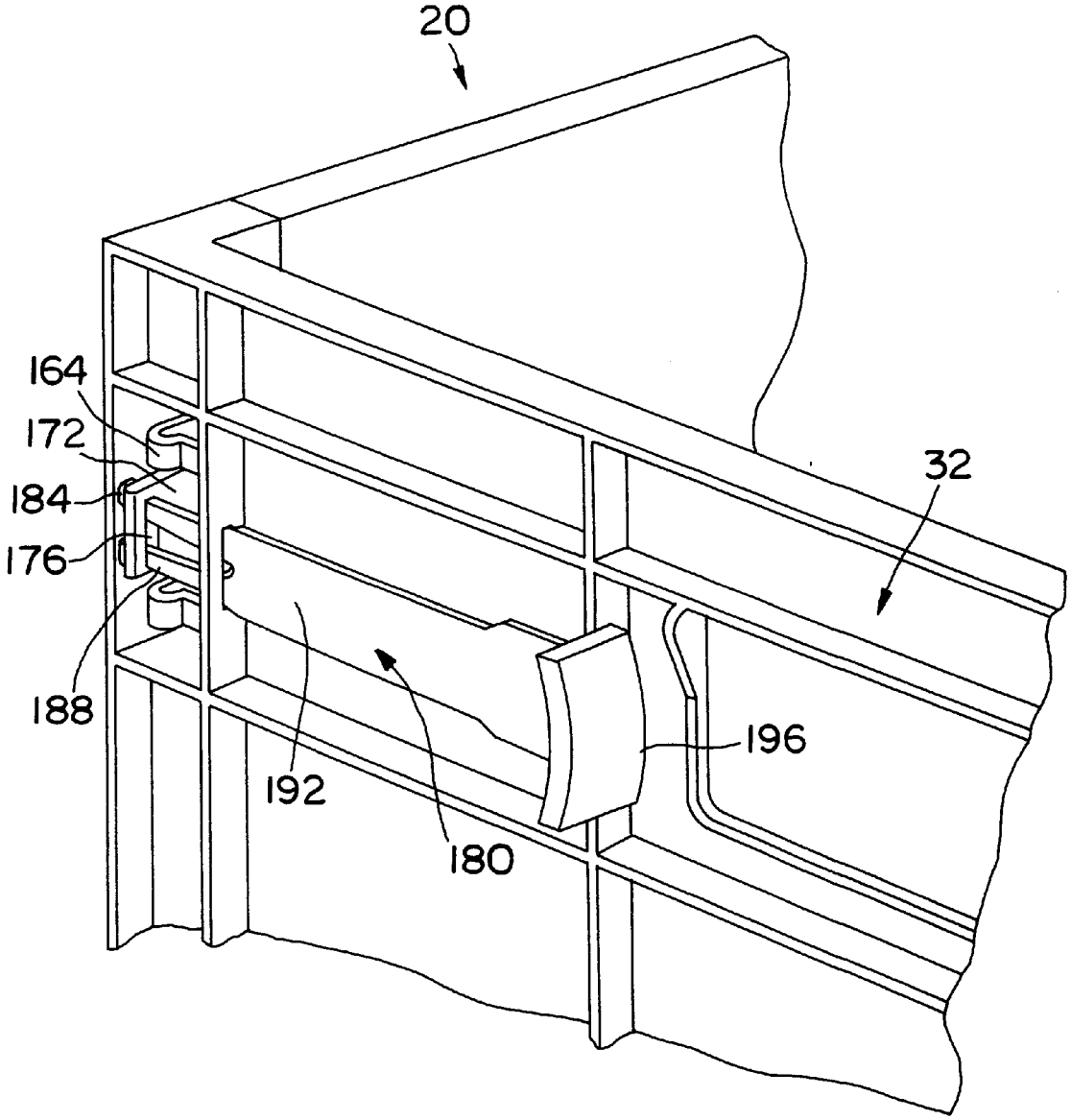
FIG. 6 is a partial perspective view of the corner of the collapsible container with the sidewalls in assembled position.
Figure 7:
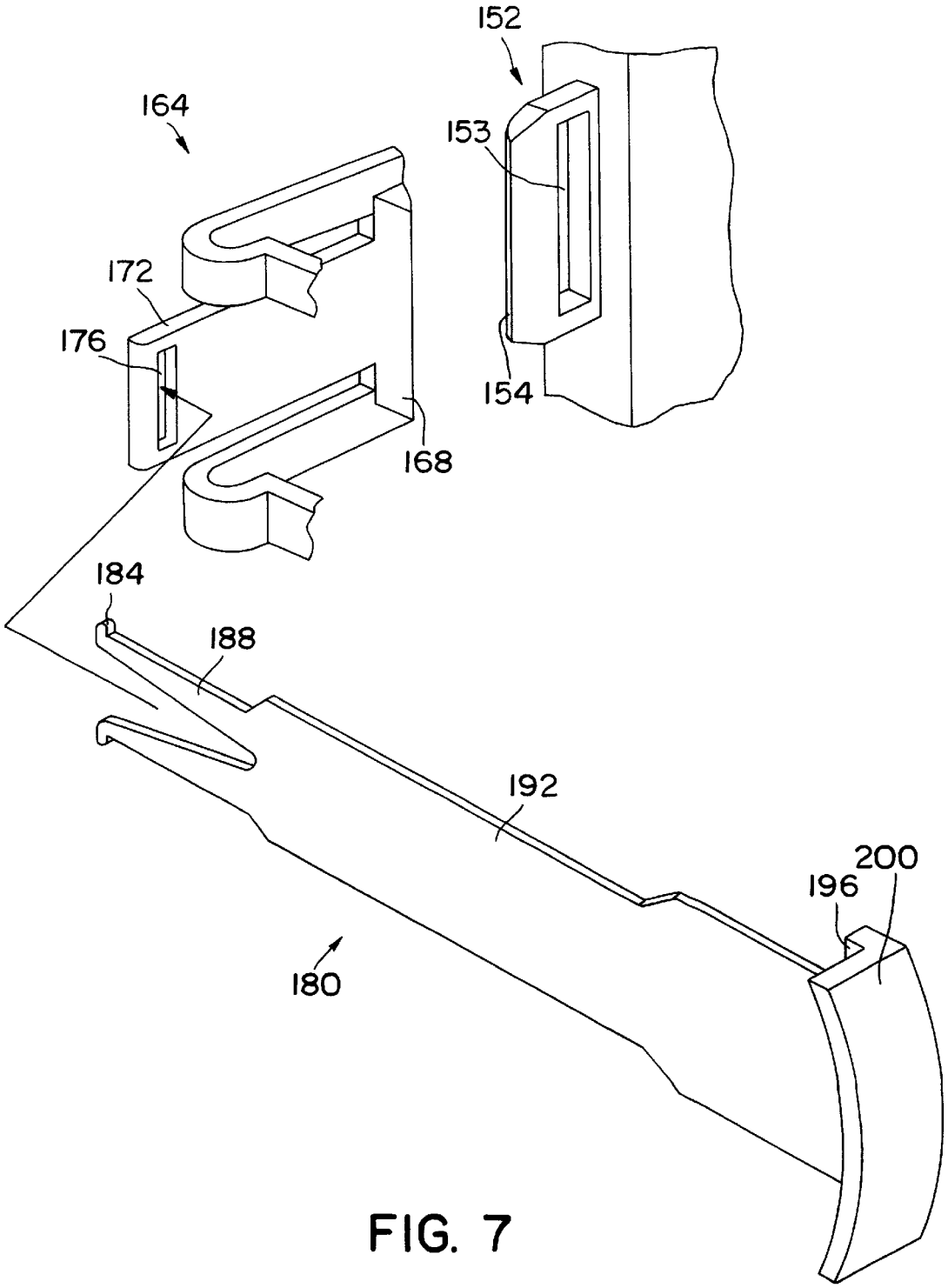
FIG. 7 is an exploded view of the latch mechanism including a catch bar, latch member, and latch actuator.

As best seen in FIGS. 6 and 7, latch member 164 has a resiliently deformable catch 168 which is biased to capture latch bar 152 by engaging with aperture 153 when sidewalls 28, 32, 36, 40 are in the assembled position. Extending from each catch 168 is a substantially rectangular catch lever 172. The free end of catch lever 172 has a substantially rectangular aperture 176 for attachment to a latch actuator 180. In a present embodiment, latch actuator 180 has a pair of outwardly-turned feet 184 that are spring-biased to engage the edges of aperture 176 so that feet 184 are retained therein. A pair of legs 188 extend, respectively, from each foot 184 and merge at a body portion 192. A grip 196 is integrally formed into actuator 180 on the end of body 192 opposite feet 184. In the present embodiment, grip 196 is substantially arcuate with a raised lip 200 for grasping. When attached to latch member 164, actuator 180 is substantially co-planar with short sidewalls 28, 32 so that grip 196 is positioned near wall handle 142. It can thus be seen that each latch actuator 180 is proximal to a corresponding latch actuator 180 of a corresponding latch member 164 on a same one of sidewalls 28, 32. Thus latch members 164 respective to corresponding latch actuators 180 are simultaneously releasable and the respective sidewall 28, 32 is moveable to one of the collapsed positions.

While FIGS. 6 and 7 show the latch between sidewalls 32 and 40, it will now be apparent that the latch between the other sidewalls are similarly arranged. In particular, each short sidewall 28, 32 has two actuators 180 with grips 196 in close proximity to each other, resulting in a single point of actuation for the pair of latch members 180 on each short sidewall 28, 32.

Figure 8:
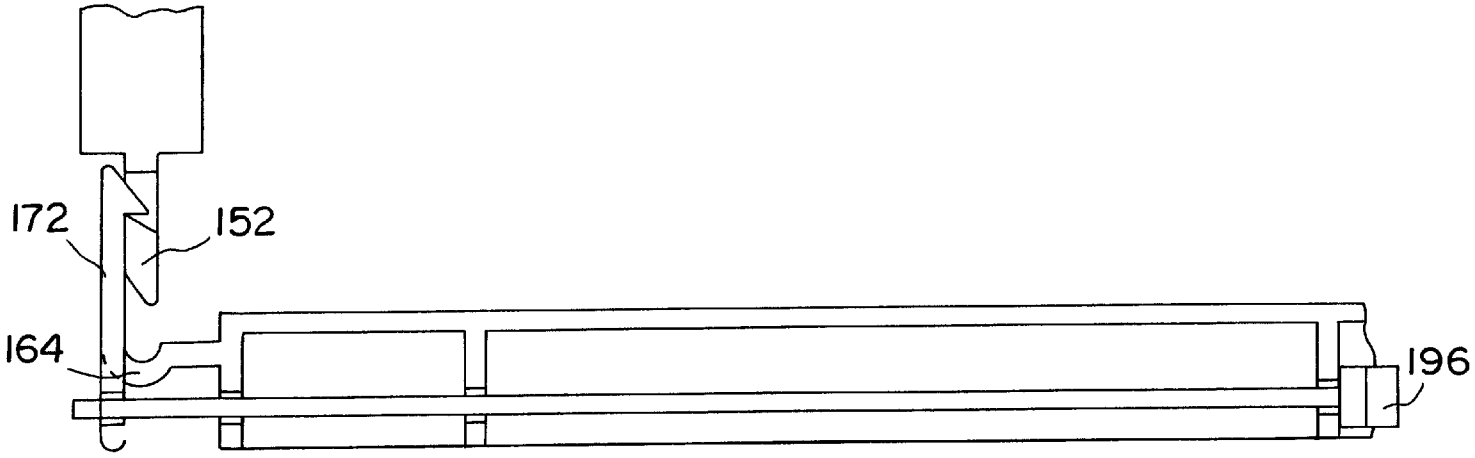
FIG. 8 is a partial top sectional view of the collapsible container in assembled position showing the catch bar, latch member, and latch actuator.

Each latch member 164 has two positions: a resting position and a flexed position. Referring now to FIG. 8, container 20 is in the assembled position and latch member 164 is in the resting position. Catch lever 172 is substantially normal to actuator 180 and catch 168 is engaged with latch bar 152. In the flexed position, shown in FIG. 9, catch lever 172 is at an obtuse angle in relation to actuator 180 so that catch 168 is disengaged from catch bar 152. Latch member 164 is movable from the rest position to the flexed position by urging grip 196 towards handle 142. Upon releasing grip 196, latch member 164 is biased towards the resting position.

The assembly of container 20 will now be described with reference to the foregoing and the attached Figures. To assemble container 20 from the outwardly collapsed position shown in FIG. 2, long sidewalls 36, 40 are pivoted so that they are substantially normal to base 24. Short sidewalls 28, 32 are pivoted so that catch 168 abuts latch bar 152. Maintaining long sidewalls 36, 40 substantially normal to base 24. external force is applied on short walls 28, 32 so that they are directed inwardly and towards each other. When force is applied on short walls 28, 32, latch member 164 is urged from the resting position to the flexed position as catch 168 slides along bevelled free end 154. Latch member 164 returns to the rest position when catch 168 engages catch aperture 153. As will now be apparent, when each of the four catches 168 engage its respective aperture 153, each sidewall 28, 32, 36, 40 is substantially perpendicular to base 24 and container 20 is assembled as shown in FIG. 1.

Figure 9:
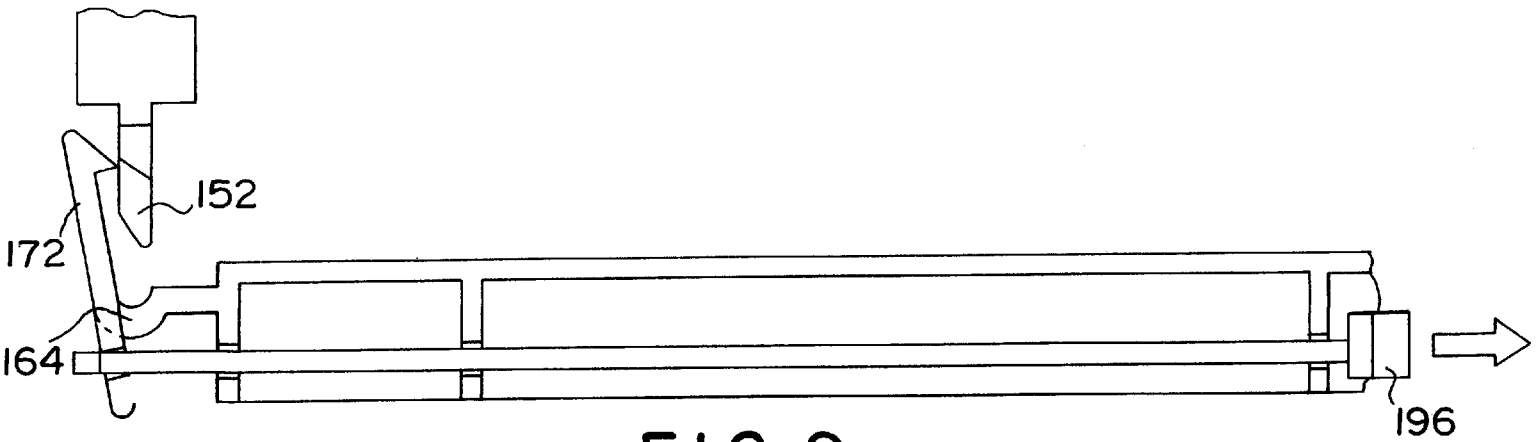
FIG. 9 is a partial top sectional view of the collapsible container with the latch member disengaged from the latch bar.

The collapsing of container 20 will now be described with reference to the foregoing and the attached Figures. To collapse container 20 from the assembled position shown in FIG. 1 to the outwardly collapsed position shown in FIG. 2, both grips 196 on each short side 28, 32 are urged towards each other by the operator. Typically the operator will pinch each grip 196 using the thumb and forefinger of each hand. Referring now to FIG. 9, latch actuator 180 is moved in the direction of arrow A, thereby applying a force on catch lever 172 and urging latch member 164 into the flexed position. As corresponding latch actuators 180 on each sidewall 28, 32 are pinched, they are urged inwardly and towards each other. At the same time, latch members 164 are urged outwardly, into the flexed position, thereby disengaging catches 168 from their respective catch apertures 153. At this point, each sidewall 28, 32 is pivoted outwardly so that it is substantially co-planar with base 24, in the outwardly collapsed position. Finally, long sidewalls 36, 40 are then pivoted away from each other into the outwardly collapsed position.

It will now be apparent that both catches 168 on one sidewall 28, 32 can be disengaged from their respective catch apertures 153 with one hand by urging the respective grips 196 together with one hand. Further, both catches 168 on both sidewalls 28, 32 can be disengaged from their respective catch apertures 153 by urging each set of grips 196 on each wall 28, 32 together using one hand on each set of grips 196. Therefore, each wall 28, 32 can be collapsed with each hand and both walls 28, 32 can be collapsed substantially simultaneously.

To collapse container 20 from the assembled position shown in FIG. 1 to the inwardly collapsed position shown in FIG. 3, both grips 196 on each short side 28, 32 are urged towards each other by the operator. Referring to FIGS. 8 and 9, latch actuator 180 is moved in the direction of arrow A, thereby applying a force on catch lever 172 and urging latch member 164 into flexed position. When both latch actuators 180 on one of sidewalls 28, 32 are urged towards each other, both latch members 164 are urged into the flexed position, thereby disengaging both catches 168 from their respective catch apertures 153. When both catches 168 on sidewall 28 are disengaged from their respective catch apertures 153, sidewall 28 is pivoted so that it is at an obtuse angle with base 24. Similarly, both latch actuators 180 on opposing sidewall 32 are urged towards each other disengaging both catches 168 from their respective catch apertures 153 and sidewall 32 is pivoted so that it is at an obtuse angle with base 24. Long sidewalls 36,40 are then pivoted inwardly, toward each other, so they are substantially parallel with base 24. Short sidewalls 28, 32 are then pivoted inwardly, toward each other so they are substantially parallel with base 24.

Figure 10:
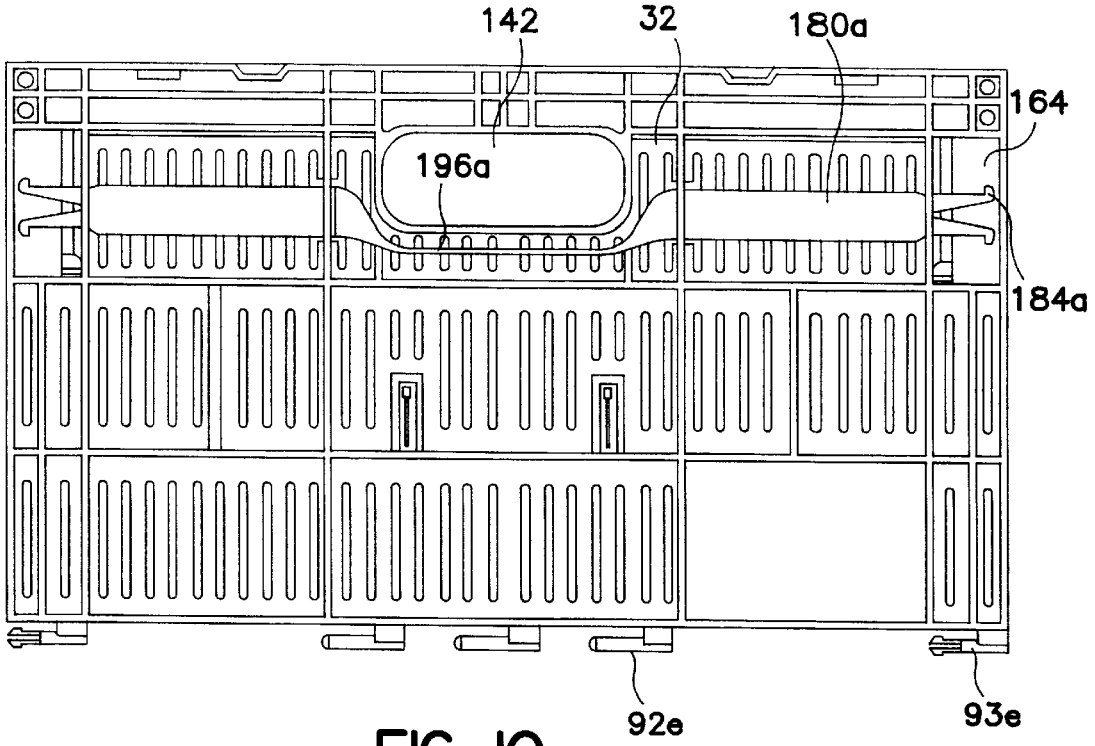
FIG. 10 is a side view of an alternative embodiment of the collapsible container.
Figure 11:
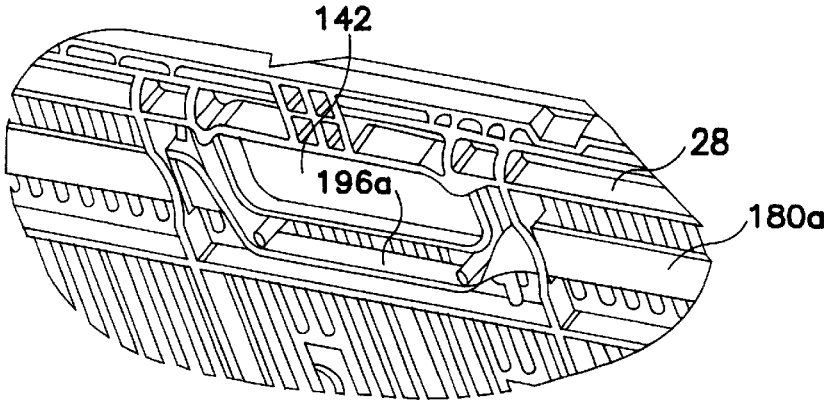
FIG. 11 is a partial perspective view of an alternative embodiment of the collapsible container.
Figure 12:
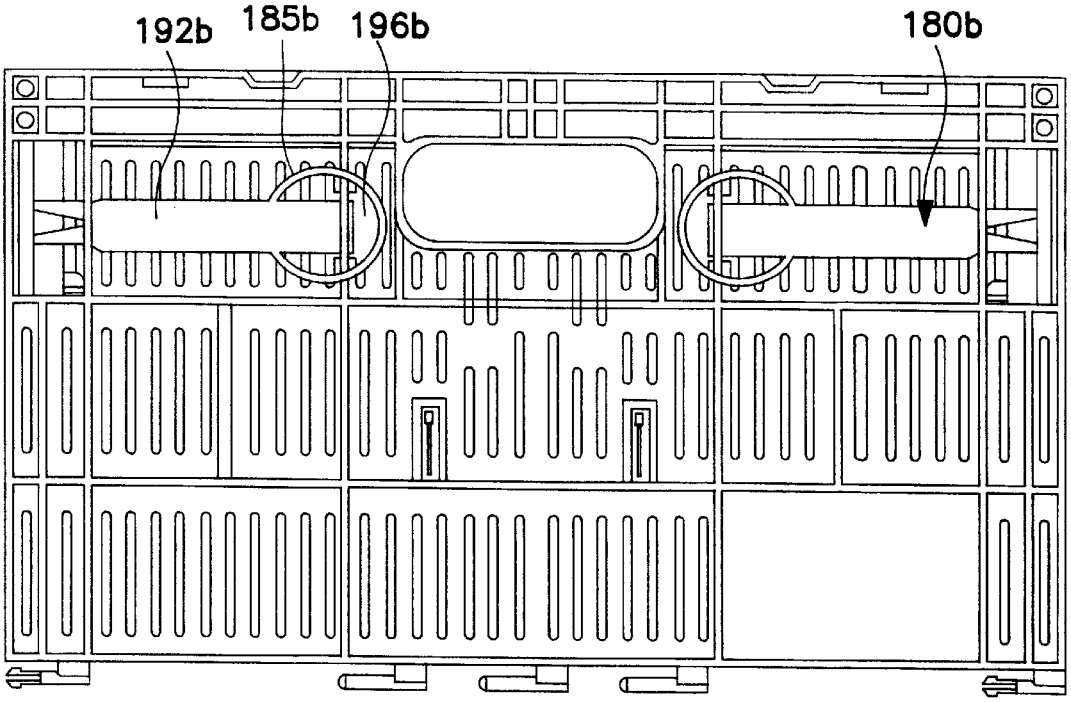
FIG. 12 is a side view of the collapsible container in a first alternative embodiment of the latch member and latch actuator.

It will be understood by those of skill in the art that the configurations of container 20 can be varied, and that such variations are within the scope of the invention. Referring now to FIGS. 10 and 11 an alternative latch actuator **180*a* is shown on short side 28. As best seen in FIG. 10, grips 196 from the previous embodiment can be eliminated and merged into a flexible single grip 196*a* proximal to handle 142. By urging single (grip 196*a* towards handle 142 each foot 184*a* is drawn inwardly, thus releasing latch members 164** respective to each foot.

Figure 13:
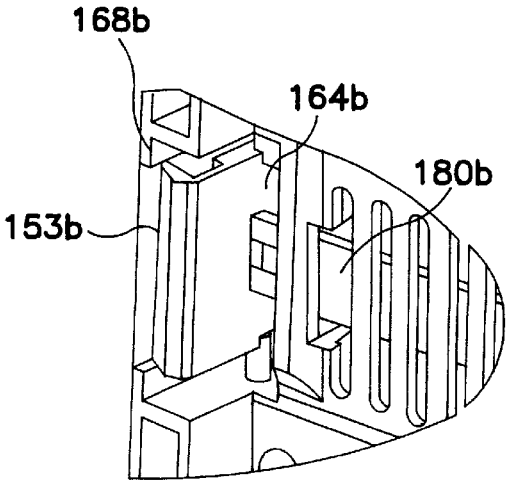
FIG. 13 is a partial perspective view of the interior of the container showing the hinged catch of the latch member engaged with the catch aperture in a first alternative embodiment of the latch member and latch actuator.
Figure 14:
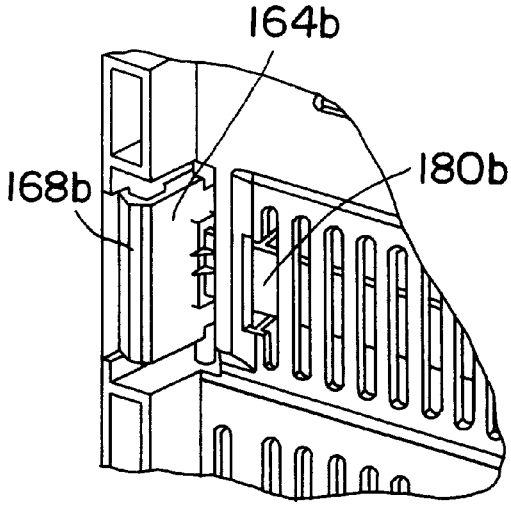
FIG. 14 is a partial perspective view of the interior of the container showing the hinged catch of the latch member engaged with the catch aperture in the first alternative embodiment of the latch member and latch actuator.
Figure 15:
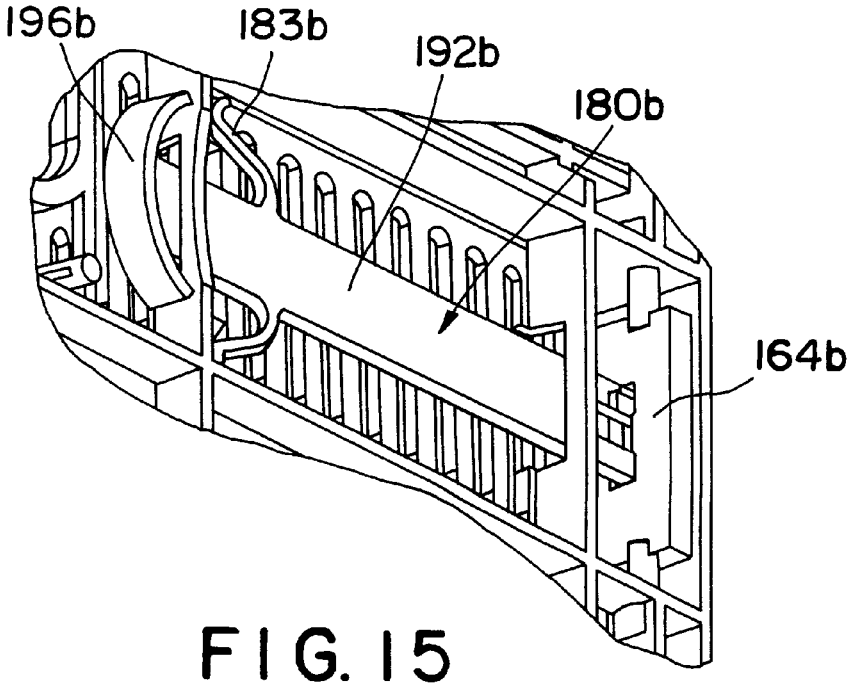
FIG. 15 is a partial perspective view of the latch actuator and latch member in the first alternative embodiment of the latch member and latch actuator.
Figure 16:
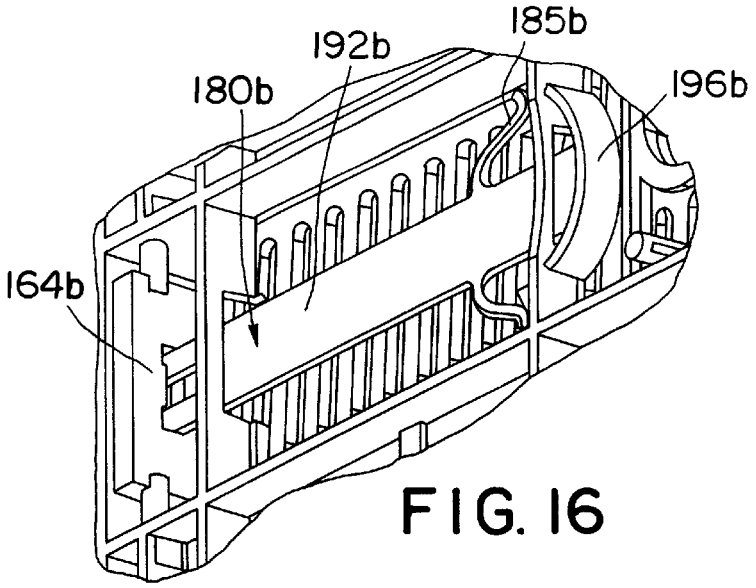
FIG. 16 is a partial perspective view of the latch actuator and latch member in the first alternative embodiment of the latch member and latch actuator.
Figure 17:
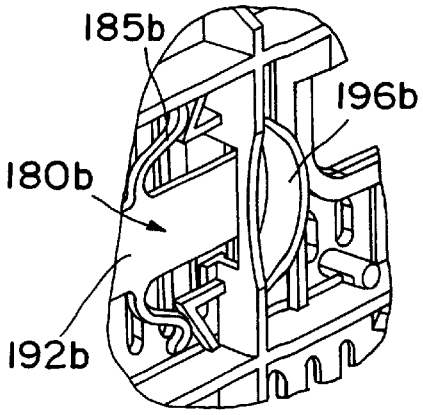
FIG. 17 is a partial perspective view of an alternative embodiment of the latch actuator in the first alternative embodiment of the latch member and latch actuator.
Figure 18:
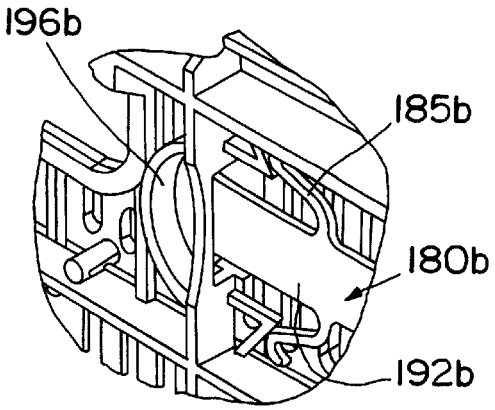
FIG. 18 is a partial perspective view of the latch actuator in the first alternative embodiment of the latch member and latch actuator.

Referring now to FIGS. 12–18, an alternative latch member 164*b* and latch actuator 180*b* are shown. As best seen in FIG. 13, the resiliently deformable catch 168 of the first embodiment is replaced with a hinged catch 168*b*. Each hinged catch 168*b* has a first position whereby catch 168*b* is engaged with its respective catch aperture 153*b*, best seen in FIG. 14. Each hinged catch 168*b* has a second position whereby catch 168*b* is pivoted away from catch aperture 153*b*, thereby disengaging catch aperture 153*b*. In addition, latch actuator 180*b* includes a pair of arms 185*b* which are joined to body 192*b* and oriented towards grip 196*b*, best seen in FIGS. 15–18. Arms 185*b* are spring-biased, having resting position that urges hinged catch 168*b* into the first position engaging catch aperture 153*b*. Arms 185*b*also have a flexed position when grip 196*b* is urged towards handle 142, which urges hinged catch 168*b* into the second position thus disengaging catch 168*b* from its respective catch aperture 153*b*.

Figure 19:
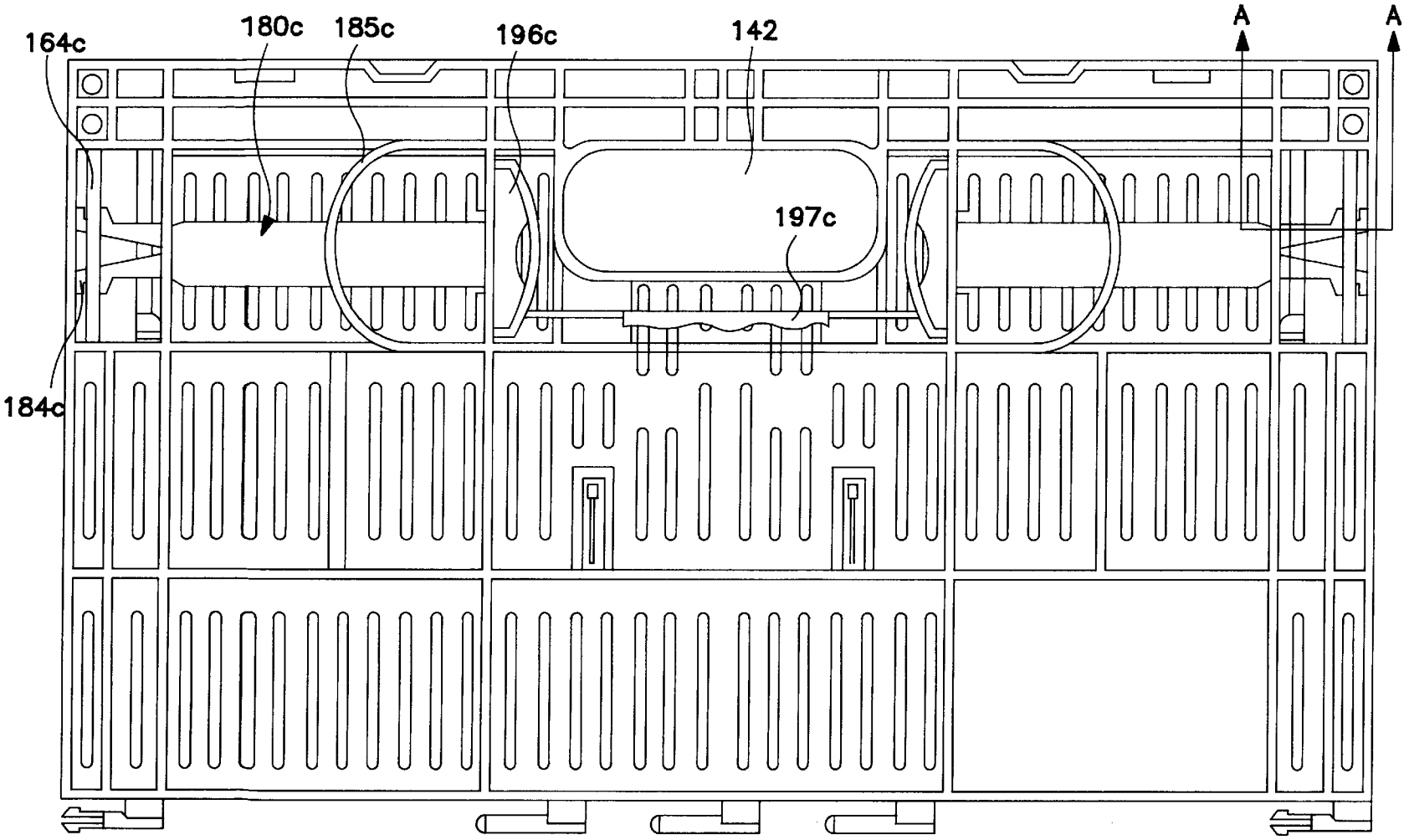
FIG. 19 is a side view of the collapsible container in a second alternative embodiment of the latch member and latch actuator.
Figure 20:
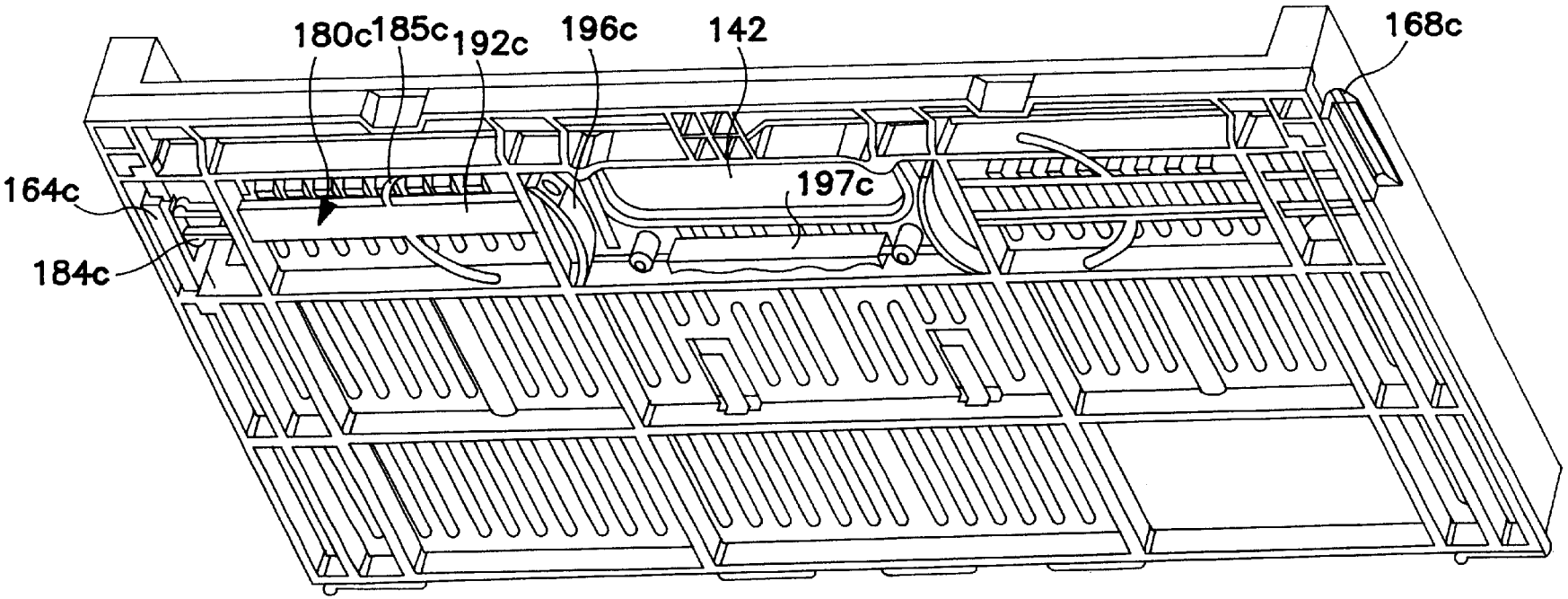
FIG. 20 is a perspective view of the side of the collapsible container in the second alternative embodiment of the latch member and latch actuator.
Figure 21:
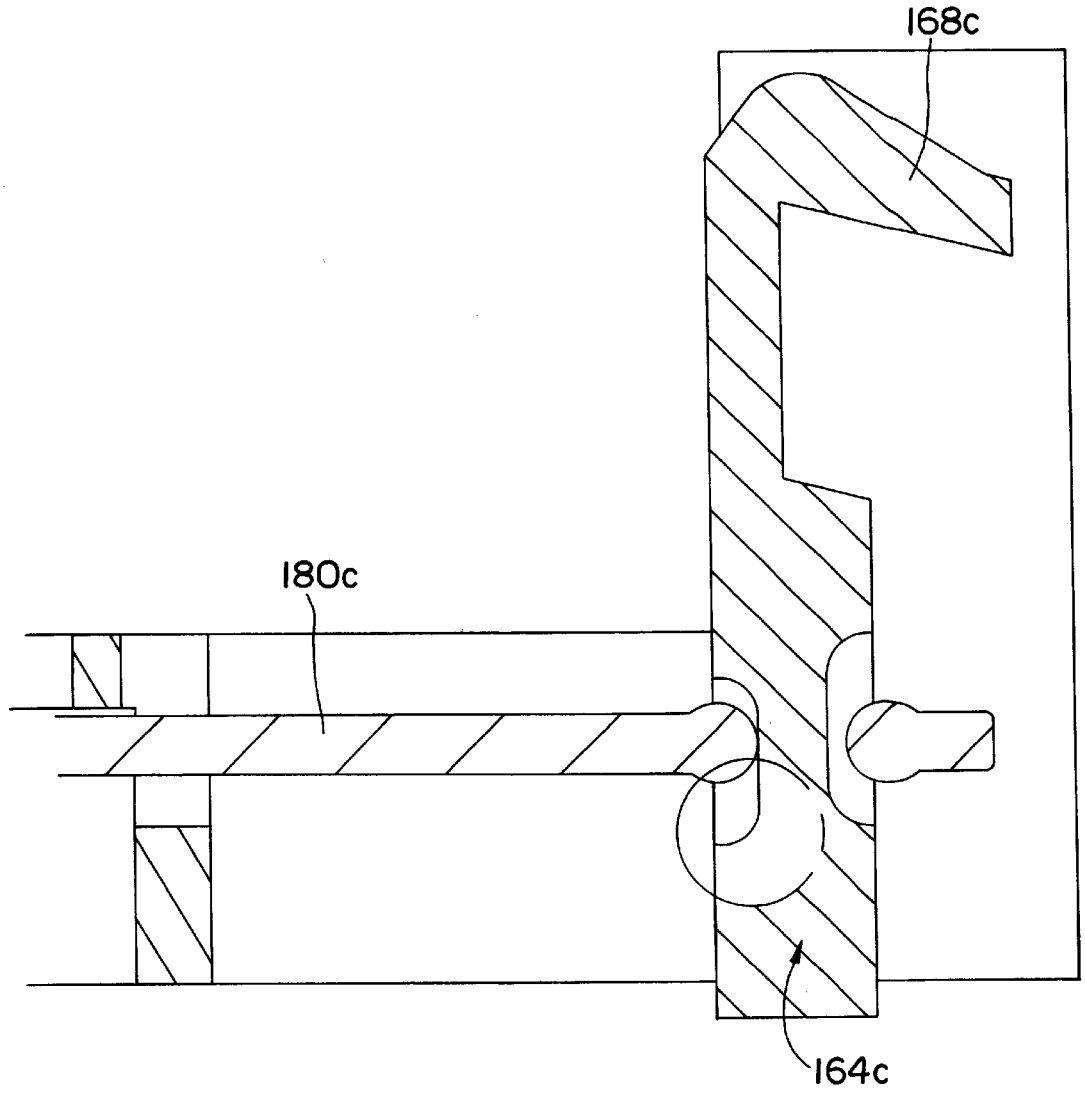
FIG. 21 is a partial sectional view of section A—A of Figure J showing the second alternative embodiment of the latch member and latch actuator.
Figure 22:
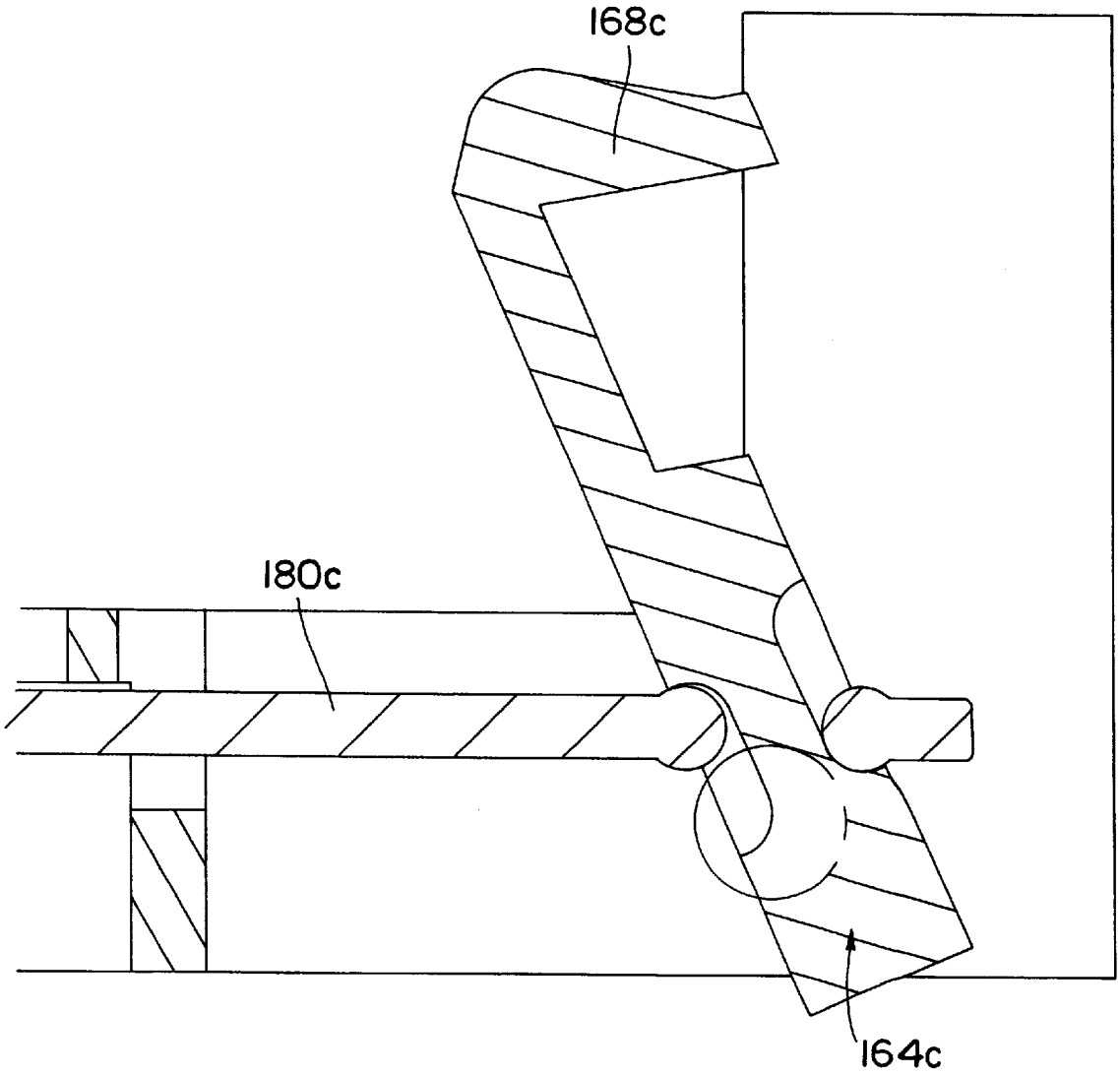
FIG. 22 is a partial sectional view of section A—A of Figure J showing the second alternative embodiment of the latch member and latch actuator.
Figure 23:
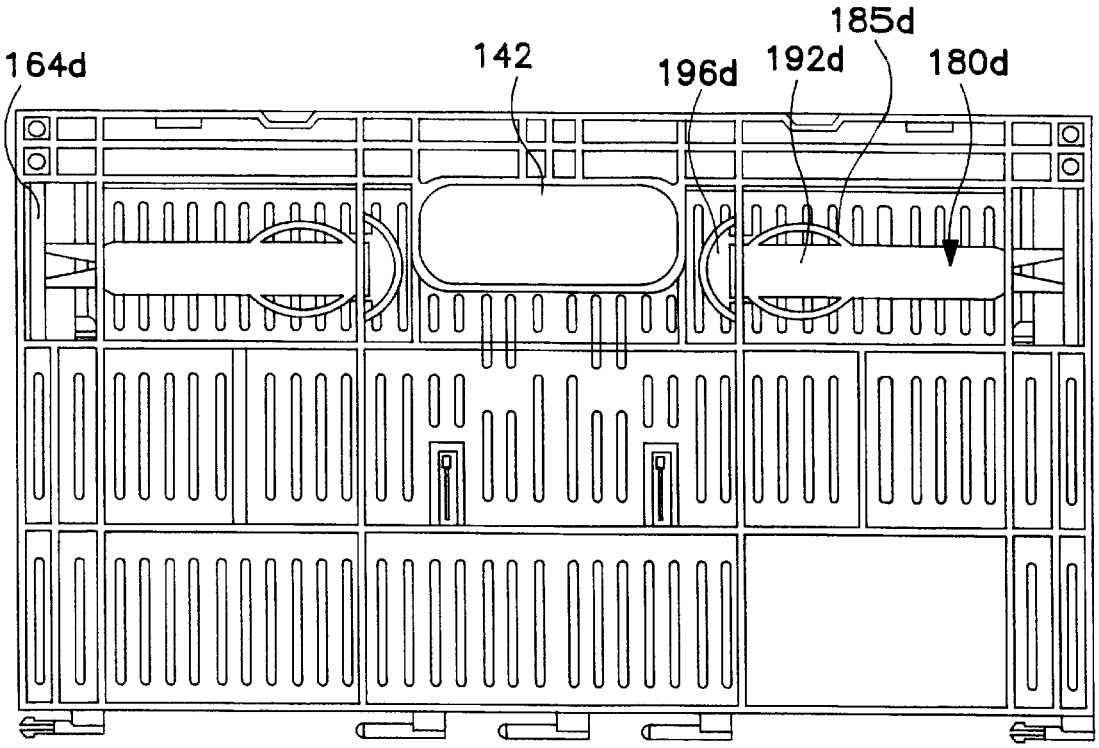
FIG. 23 is a side view of the collapsible container in a third alternative embodiment of the latch member and latch actuator.

Referring now to FIGS. 19–22, a second alternative latch member 164*c* and latch actuator 180*c* are shown. As best seen in FIG. 21, similar to hinged catch 168*b* of the previous embodiment, each hinged catch 168*c* has a first position whereby catch 168*c* is engaged with its respective catch aperture 153*c*. As best seen in FIG. 22, each hinged catch 168*c* has a second position whereby catch 168*c* is pivoted away from catch aperture 153*c*, thereby disengaging catch aperture 153*c*. As best seen in FIG. 19, each latch actuator includes a pair of splayed feet 184*c*. Splayed feet 184*c* each grasp their respective latch member 164*c*. In addition, latch actuator 180*c* includes a pair of arms 185*c* which are joined to body 192*c* and oriented towards feet 184*c*. Arms 185*c* are spring-biased, having a resting position that urges hinged catch 168*c* into the first position engaging catch aperture 153*c*. Arms 185*c* also have a flexed position when grip 196*c* is urged towards handle 142, which urges hinged catch 168*c* into the second position thus disengaging catch 168*c* from its respective catch aperture 153*c*. The present embodiment also includes a single grip 197*c*, which interconnects each grip 196*c*. By urging single grip 197*c* towards handle 142, feet 184*c* are urged inwardly, and thus releasing latch members 164 respective to each foot.

Figure 24:
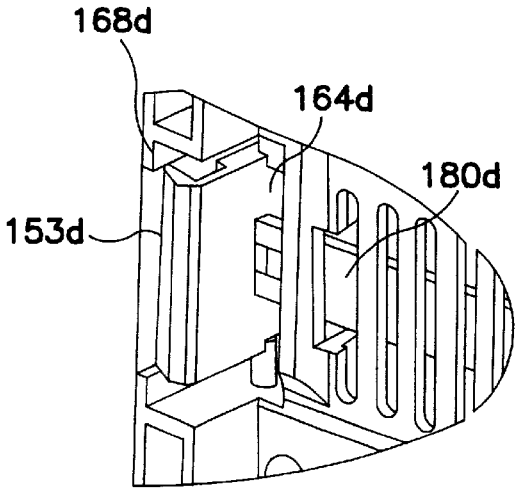
FIG. 24 is a partial perspective view of the interior of the container showing the hinged catch of the latch member engaged with the catch aperture in the third alternative embodiment of the latch member and latch actuator.
Figure 25:
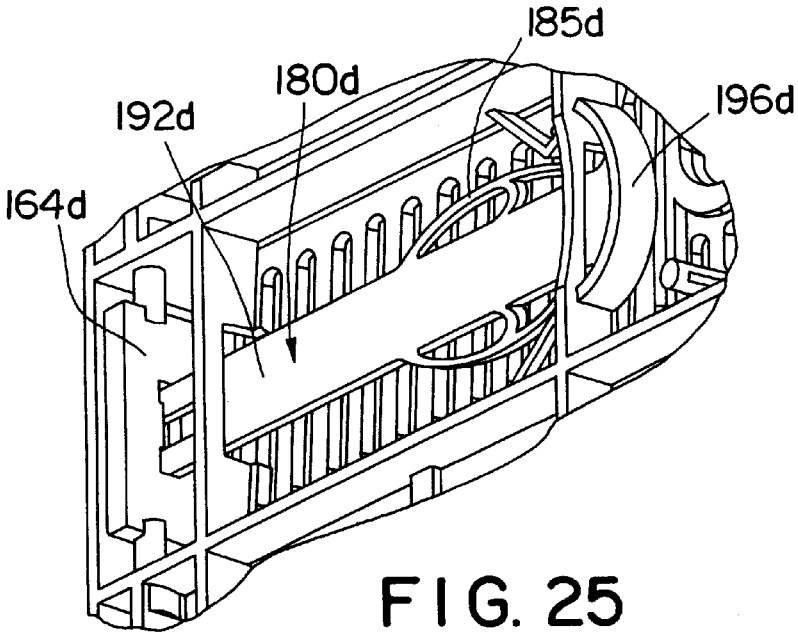
FIG. 25 is a partial perspective view of the latch actuator and latch member in the third alternative embodiment of the latch member and latch actuator.
Figure 26:
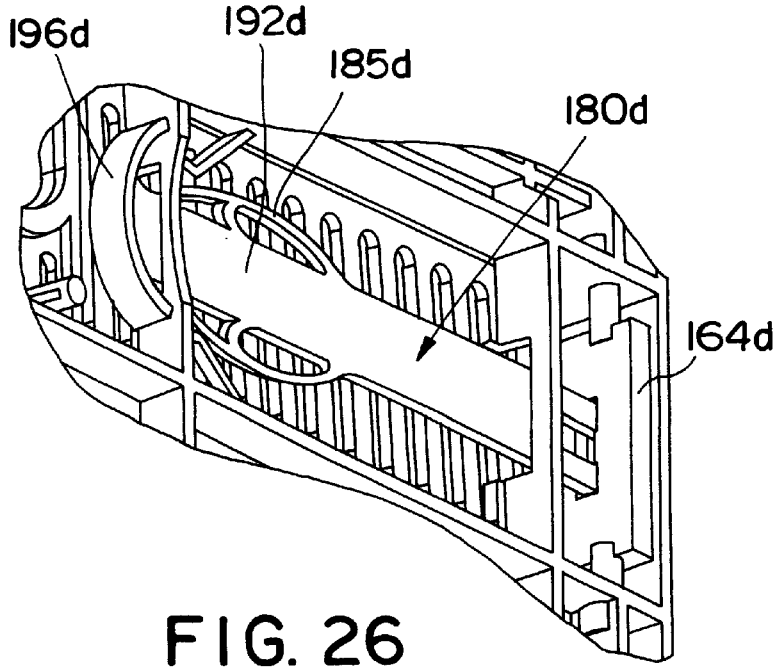
FIG. 26 is a partial perspective view of the latch actuator and latch member in the third alternative embodiment of the latch member and latch actuator.

Referring now to FIGS. 23–26, a third alternative latch member 164*d* and latch actuator 180*d* are shown. As best seen in FIG. 24, similar to hinged catch 168*b* of the previous embodiment, each hinged catch 168*d* has a first position whereby catch 168*d* is engaged with its respective catch aperture 153*d*. Each hinged catch 168*d* has a second position whereby catch 168*d* is pivoted away from catch aperture 153*d*, thereby disengaging catch aperture 153*d*. In addition, latch actuator 180*d* includes a pair of arms 185*d* which are joined to body 192*d* at both ends. Arms 185*d* are spring-biased, having a resting position that urges hinged catch 168*d* into the first position engaging catch aperture 153*d*. Arms 185*d* also have a flexed position when grip 196*d* is urged towards handle 142, which urges hinged catch 168*d* into the second position thus disengaging catch 168*d* from its respective catch aperture 153*d*.

Figure 27:
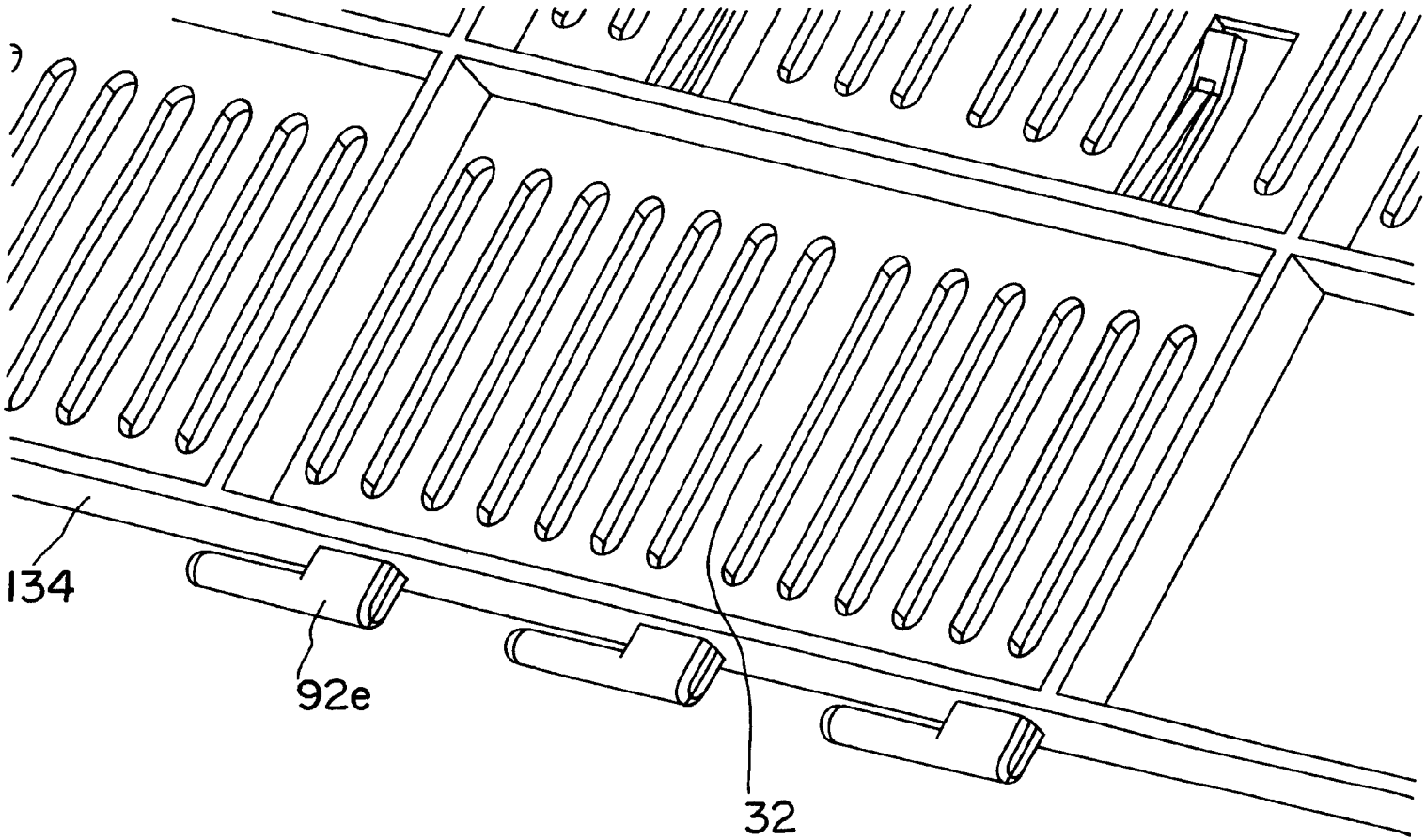
FIG. 27 is a partial perspective view of one side of the container showing an alternative embodiment of the hinge posts.
Figure 28:
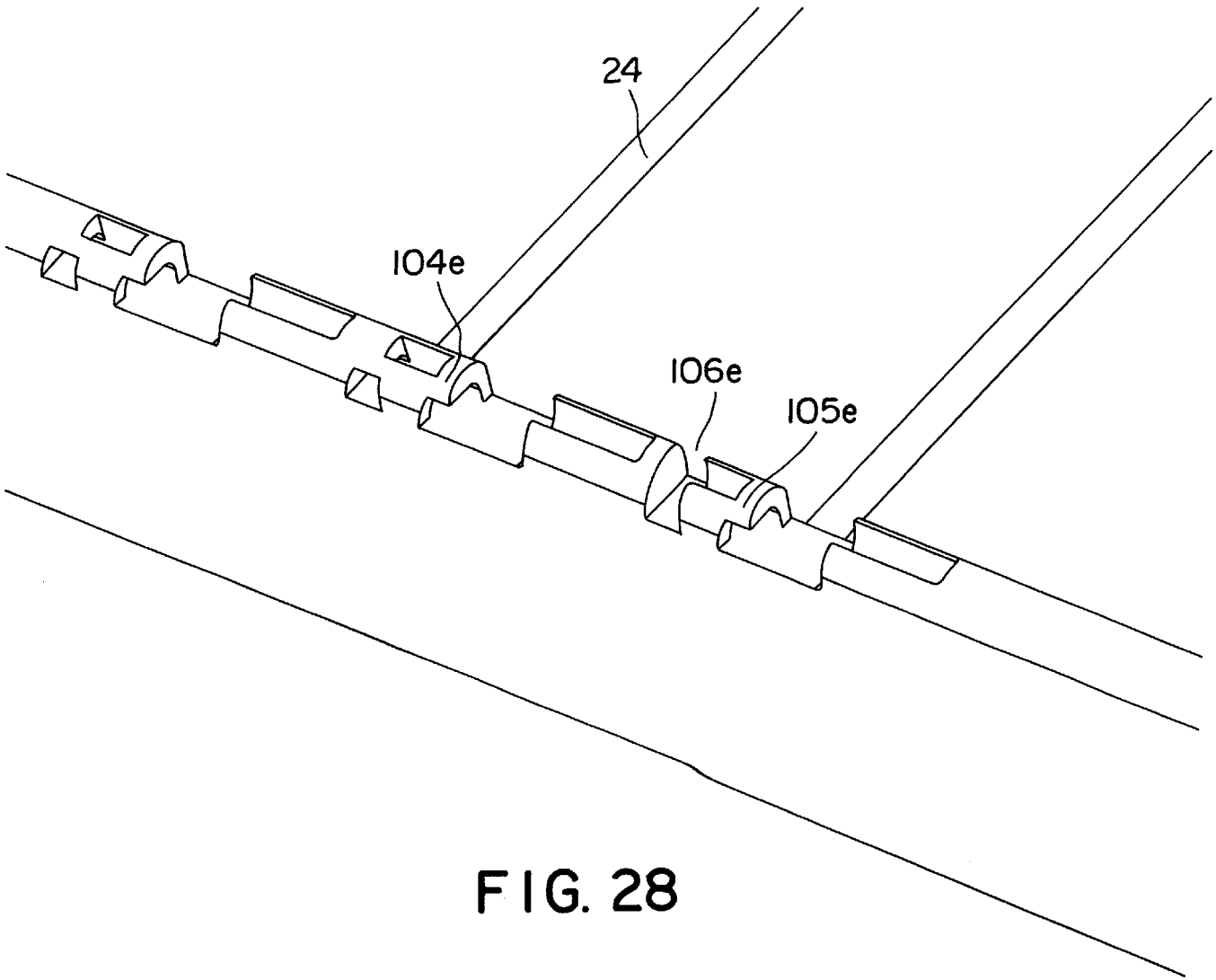
FIG. 28 is a partial perspective view of one side of the base of the container showing an alternative embodiment of the hangers.
Figure 29:
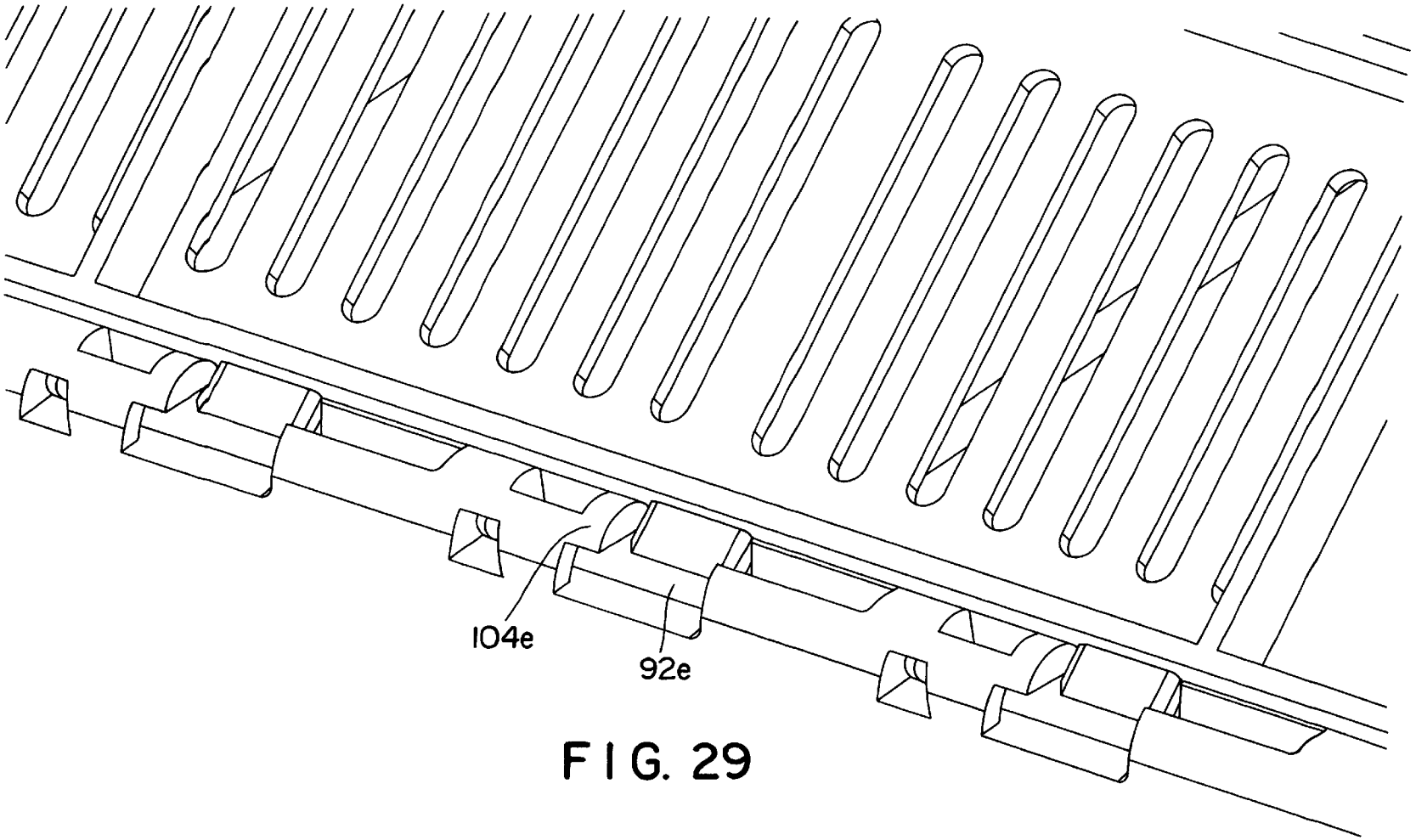
FIG. 29 is a partial perspective view of one side and the base of the container showing the alternative embodiment of the hinge posts and hangers.

Referring now to FIGS. 10, 27–29, an alternative hinge post 92*e*, 100*e* and hanger 104*e*, 108*e* arrangement is shown. As best seen in FIG. 27, hinge posts 92, 100 from the first embodiment can be eliminated and replaced by L-shaped hinge posts 92*e*. As shown in FIG. 10, three L-shaped hinge posts 92*e* project from contacting edge 134 and are centred on sidewall 32. A split-cap L-shaped hinge post 93*e* projects from contacting edge 134, proximal to each short side 112 of sidewall 32. It will now be understood by those of skill in the art that each sidewall 28, 36, 40 can have L-shaped hinge posts 92*e* and split-cap L-shaped hinge posts 93*e* in similar arrangement to sidewall 132. Hangers 104, 108 from the first embodiment are replaced by hangers 104*e*, as shown in FIG. 28. Each L-shaped hinge post 92*e* is received by complementary hanger 104*e* for pivotal attachment of sidewalls 28, 32, 36, 40 as best shown in FIG. 29. Similarly, each split-cap L-shaped hinge post 93*e* is received by a complimentary hanger 105*e*. Split-cap L-shaped hinge posts 93*e* interlock with apertures 106*e* on hangers 105*e*. The removal of split-cap L-shaped hinge posts 93*e* from respective hangers 105*e* is difficult thereby making the detachment of sidewalls 28, 32, 36, 40 from base 24 difficult.

Figure 30:
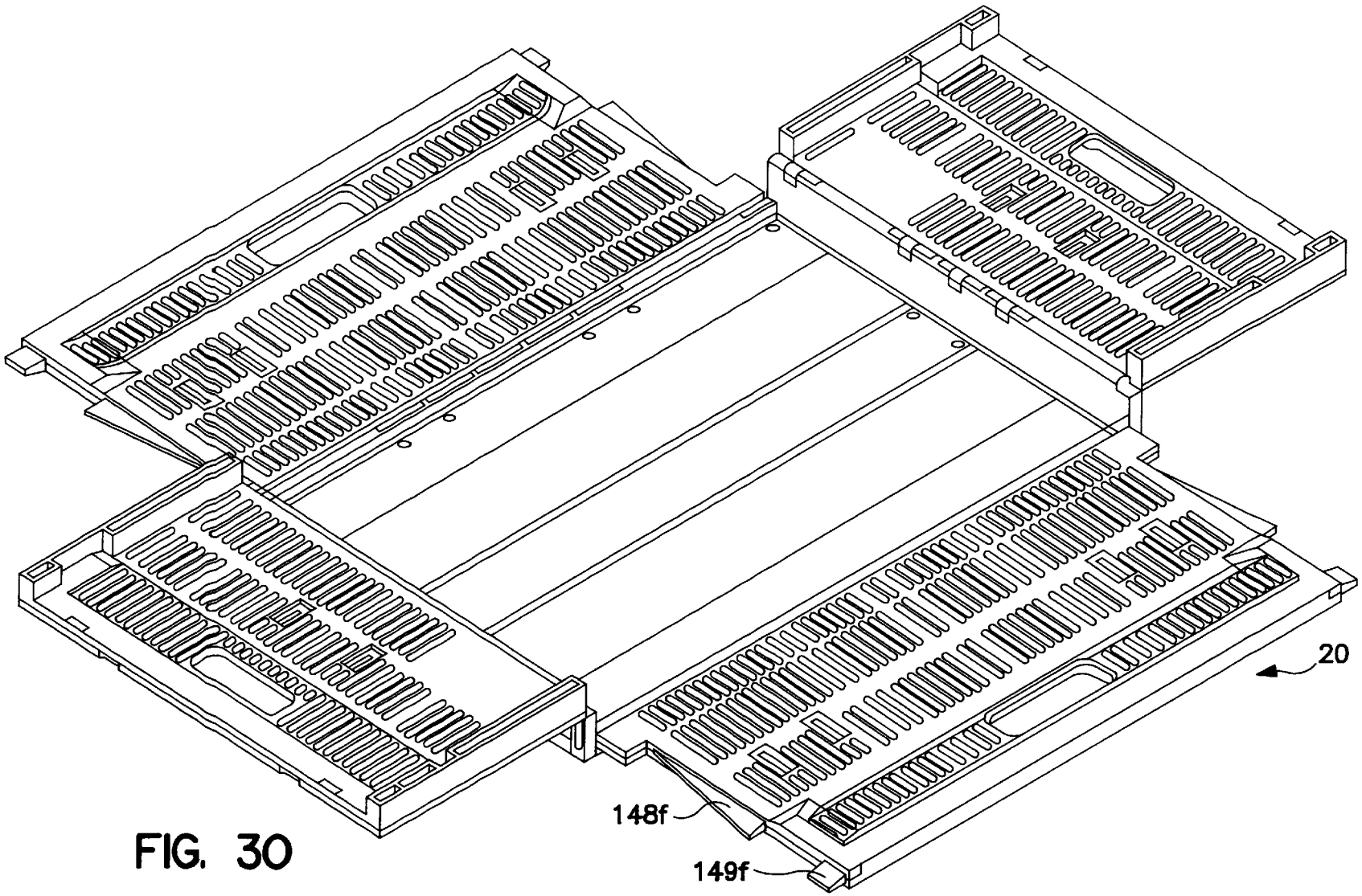
FIG. 30 is a perspective view of container 20 in the outwardly collapsed position in an alternative embodiment of the tab configuration.

Referring now to FIG. 30, tabs 148 from the first embodiment can be replaced by a first tab 148*f* and a second tab 149*f*. First tab 148*f* is tapered inwardly as shown in FIG. 30. The tapered first tab 148*f* reduces interference between short sidewalls 28, 32 and long sidewalls 36, 40 when assembling container 20. The tapered first tab 148*f* allows the operator to pivot sidewalls 28, 32, 36, 40 substantially normal to base 24 in any order when assembling container 20 from the collapsed positions.

While the embodiments discussed herein are directed to particular implementations of the present invention, it will be apparent that the subsets and variations to these embodiments are within the scope of the invention. For example, the sidewalls can differ in length from above or all four sidewalls can be equal in length. Alternatively, the container can have a cover to protect the goods stored therein. Also. the container can have a plurality of apertures for ambient circulation. The hinge configuration may differ. The shape of the grips may be varied such as including an aperture for inserting one's finger or thumb for actuating. The shape of the latch actuator may be changed or the latch member configuration can differ. Also, the latch catch and aperture can have different configurations to achieve the same function.

The present invention provides a novel collapsible container for transport or storage of products such as produce or other perishables. In one embodiment, there is provided a five piece collapsible container with a base and four sides that can be collapsed outwardly to facilitate washing and inwardly for compact storage. The container has latches and actuating members with grips that allow the operator to disengage both respective latches on one side of the container with one hand from an actuation point on the side of the container. Similarly, when collapsing the container from assembled position, all four latches can be disengaged with one hand at each actuation point. The latches are readily disengageable while providing a rigid assembled container. By providing a single point of actuation, both latches on one sidewall can be substantially simultaneously disengaged and the sidewall collapsed with one hand. Similarly, with one hand on each opposing sidewall, all four latches can be simultaneously disengaged and the sidewalls moved into their collapsed positions with each hand at each respective actuation point. Also, the container is readily collapsed for washing and storage thereby allowing processing by the operator. Also, less effort can be required as the latches are easily engaged and disengaged with reduced strain on the hand.

What is claimed is:

1. A collapsible container comprising:

a base;

a pair of first opposing sidewalls pivotably attached to said base;

a pair of second opposing sidewalls pivotably attached to said base, said sidewalls having an assembled position, an outwardly collapsed position, and an inwardly collapsed position;

a latch bar attached to each end of each of said first opposing sidewalls;

a latch member attached to each end of said second opposing sidewalls, said latch member being biased to releasably capture a respective latch bar when said walls are in the assembled position; and a latch actuator attached to each said latch member and extending along a respective said second sidewall to a grip, each said second sidewall having a pair of said grips proximal to each other such that each pair of said (grips can be actuated with one hand to urge said latch member to release said latch bar.

2. The container in claim 1 wherein said latch bar comprises a substantially rectangular, protruding bar and a catch aperture for engaging said latch member.

3. The container in claim 2 wherein said latch member comprises a resiliently deformable catch to capture said latch bar with a substantially rectangular catch lever extending therefrom, said catch lever having an aperture for attachment to said latch actuator.

4. The container in claim 3 wherein said latch actuator comprises:

a pair of outwardly turned feet to engage the edges of said aperture so that said feet are retained therein;

a pair of legs extending, respectively from each of said feet;

a body portion at which said legs merge; and said grip integrally formed with said actuator for grasping with a finger or hand.

5. The container in claim 4 wherein said grip is substantially semi-circular with a protruding semicircular lip for grasping with a finger.

6. The container in claim 4 wherein said grip comprises an aperture for inserting a finger to grasp and actuate said latch member.

7. The container in claim 2 wherein said latch member comprises: a resiliently deformable catch to capture said latch bar with a substantially rectangular catch lever extending therefrom, said catch lever having a pair of outwardly turned feet to engage said latch actuator.

8. The container in claim 7 wherein said latch actuator comprises:

a substantially rectangular body portion; with an aperture, the edges of said aperture to be engaged with said feet; and said grip integrally formed with said actuator, opposing said aperture, for grasping with a finger or hand.

9. A latch for a collapsible container, said container having:

a base; a pair of first opposing sidewalls pivotably attached to said base; a pair of second opposing sidewalls pivotably attached to said base, said sidewalls having an assembled position, an outwardly collapsed position and an inwardly collapsed position; said latch comprising:

a latch bar attached to each end of said first pairs of opposing sidewalls;

a latch member attached to each end of the other of said second opposing sidewalls for releasably capturing said latch bar; and a latch actuator attached to each said latch member and extending along a respective said second sidewall to an integrally formed grip, each said second sidewall having a pair of grips proximal to each other such that each pair of grips can be actuated with one hand to urge said latch member to release said latch bar.

10. A collapsible container comprising;

a base and two pairs of opposing sidewalls pivotably attached to said base, said sidewalls having an assembled position, an outwardly collapsed position, and an inwardly collapsed position, said sidewalls having latches that releasably lock said sidewalls in said assembled position; and a latch actuator respective to each latch, each latch actuator being proximal to a corresponding latch actuator on a same one of said sidewalls such that latches respective to corresponding actuators are simultaneously releasable by a single hand and said same sidewall is movable to one of said collapsed positions.

11. The container in 10 wherein said latch comprises:

a latch bar attached to each end of one of said pairs of opposing sidewalls;

a latch member attached to each end of the other of said pairs of opposing sidewalls, for releasably capturing a respective latch bar when said sidewalls are in said assembled position.

12. The container in claim 11 wherein said latch bar, comprises a substantially rectangular, protruding bar and a catch aperture for engaging said latch member.

13. The container in claim 12 wherein said latch member comprises: a resiliently deformable catch to capture said latch bar with a substantially rectangular catch lever extending therefrom, said catch lever having a pair of outwardly turned feet to engage said Latch actuator.

14. The container in claim 13 wherein said latch actuator comprises:

a substantially rectangular body portion; with an aperture, the edges of said aperture to be engaged with said feet; and a grip integrally formed with said actuator, opposing said aperture, for grasping with a finger or hand.

15. The container in claim 12 wherein said latch member comprises: a resiliently deformable catch to capture said latch bar with a substantially rectangular catch lever extending therefrom, said catch lever having an aperture for attachment to said latch actuator.

16. The container in claim 15 wherein said latch actuator comprises:

a pair of outwardly turned feet to engage the edges of said aperture so that said feet are retained therein;

a pair of legs extending, respectively, from each of said feet;

a body portion at which said legs merge; and a grip integrally formed with said actuator for grasping with a finger or hand.

17. The container in claim 16 wherein said grip is substantially semi-circular with a protruding semi-circular lip for grasping with a finger.

18. The container in claim 16 wherein said grip comprises an aperture for inserting a finger to grasp and actuate said latch member.

19. A latch for a collapsible container, said container having:

a base; a pair of first opposing sidewalls pivotably attached to said base; a pair of second opposing sidewalls pivotably attached to said base, said sidewalls having an assembled position, an outwardly collapsed position, and an inwardly collapsed position; said latch comprising:

a latch bar attached to each end of said first pairs of opposing sidewalls;

a latch member attached to each end of the other of said second opposing sidewalls for releasably capturing said latch bar; and a latch actuator attached to each said latch member and extending along a respective said second sidewall to an integrally formed grip, each said grip being actuatable simutaneously by a single hand to urge a pair of said latch members to release said latch bar.

20. The container in claim 10, wherein the container further comprises a grip coupled to both the corresponding actuators such that the latches respective to the corresponding actuators are substantially simultaneously releasable by actuating the grip with a single hand.

21. The container in claim 1, wherein the container further comprises a grip member attached to each of the grips proximal to each other such that the grip member can be actuated with one hand to substantially simultaneously urge each corresponding latch member to release each respective latch bar.

22. A collapsible container comprising;

a base;

two pairs of opposed sidewalls pivotally attached to the base;

at least one pair of latch mechanisms, each latch mechanism releasably engaging an adjacent pair of the sidewalls when the sidewalls are in an assembled position; and a latch actuator connected to the at least one pair of latch mechanisms, the latch actuator operable by a single hand to substantially simultaneously disengage the pair of latch mechanisms.

23. The container in claim 22, wherein the sidewalls are pivotable between an assembled position and a collapsed position.

24. The container in claim 23, wherein the latch mechanism comprises a first latch portion disposed on a first one of the adjacent pair of sidewalls and a second latch portion disposed on a second one of the adjacent pair of sidewalls, the second latch portion for releasably engaging the first latch portion when the sidewalls are in the assembled position.

25. The container in claim 24, wherein the first latch portion comprises a substantially rectangular protruding bar and an aperture, the first latch portion extending from an end of the first one of the adjacent pair of sidewalls, for releasably engaging the second latch portion.

26. The container in claim 25, wherein the second latch portion comprises a resiliently deformable catch to releasably engage the first latch portion, and a catch lever extending from the catch.

27. The container in claim 26, wherein the latch actuator comprises a grip having a pair of flexible arms, each flexible arm extending from an end of the single grip and connected to an extending body portion, the extending body portion coupled to the catch lever.

28. A collapsible container comprising;

a base;

first and second pairs of opposed sidewalls, each sidewall pivotally attached to the base and moveable between an assembled position and a collapsed position;

a plurality of latch bars, each latch bar attached to an end of each of the first pair of opposed sidewalls;

a plurality of latch members, each latch member attached to an end of each of the second pair of opposed sidewalls and operable to releasably engage a respective one of the latch bars when the sidewalls are in the assembled position; and a pair of grip members, each grip member coupled to a pair of the latch members on a corresponding one of the second pair of opposed sidewalls, the grip member operable by a single hand to substantially simultaneously urge the pair of latch members to release each respective latch bar.

29. The container in claim 28, wherein the latch bar comprises a substantially rectangular protruding bar and an aperture for engaging with the latch member.

30. The container in claim 29, wherein the latch member comprises a resiliently deformable catch for releasably engaging the latch bar, and a catch lever extending from the catch.

31. The container in claim 30, wherein the grip member comprises a grip having a pair of flexible arms, each flexible arm extending from an end of the grip and connected to an extending body portion coupled to the catch lever.

* * * * *